US007389806B2

(12) United States Patent
Kates

(10) Patent No.: US 7,389,806 B2
(45) Date of Patent: Jun. 24, 2008

(54) MOTORIZED WINDOW SHADE SYSTEM

(76) Inventor: Lawrence Kates, 1111 Bayside Dr., Corona Del Mar, CA (US) 92625

( * ) Notice: Subject to any disclaimer, the term of this patent is extended or adjusted under 35 U.S.C. 154(b) by 280 days.

(21) Appl. No.: 11/065,487

(22) Filed: Feb. 24, 2005

(65) Prior Publication Data

US 2006/0185799 A1 Aug. 24, 2006

(51) Int. Cl.
*E05F 15/20* (2006.01)

(52) U.S. Cl. ..... 160/5; 318/266; 160/310

(58) Field of Classification Search ..... 318/264, 318/286, 466, 626; 16/5; 160/5

See application file for complete search history.

(56) References Cited

U.S. PATENT DOCUMENTS

| | | | | |
|---|---|---|---|---|
| 2,492,721 | A | | 12/1949 | Vita |
| 2,606,607 | A | | 8/1952 | Vita |
| 3,186,473 | A | | 6/1965 | Myers et al. |
| 3,294,152 | A | | 12/1966 | Kuijvenhoven |
| 4,307,768 | A | * | 12/1981 | Anderson ..... 160/84.06 |
| 4,665,965 | A | | 5/1987 | Pasquier et al. |
| 4,766,941 | A | | 8/1988 | Sloop et al. |
| 4,881,219 | A | | 11/1989 | Jacquel |
| 4,974,658 | A | | 12/1990 | Komatsu et al. |
| 5,105,871 | A | | 4/1992 | Baud et al. |
| 5,142,396 | A | * | 8/1992 | Divjak et al. ..... 398/108 |
| 5,220,721 | A | | 6/1993 | Thierry |
| 5,225,748 | A | | 7/1993 | Haring |
| 5,230,416 | A | | 7/1993 | Itoh et al. |
| 5,237,168 | A | | 8/1993 | Glust et al. |
| 5,237,169 | A | | 8/1993 | Grehant |
| 5,313,999 | A | | 5/1994 | Colson et al. |
| 5,328,113 | A | | 7/1994 | de Chevron Villette et al. |

(Continued)

FOREIGN PATENT DOCUMENTS

EP 1276250 A2 1/2003

(Continued)

OTHER PUBLICATIONS

Somfy Headrail Profile Guide For Motorization With CONCEPT 25 & LS40 Cord Take-up Systems (CTS), Jan. 2003, 5 pages.

(Continued)

*Primary Examiner*—Lincoln Donovan
*Assistant Examiner*—Antony M. Paul
(74) *Attorney, Agent, or Firm*—Knobbe, Martens, Olson & Bear, LLP

(57) ABSTRACT

An electronically-controlled roll-up window shade that can easily be installed by a homeowner or general handyman is disclosed. The motorized shade includes an internal power source, a motor, and a communication system to allow for remote control of the motorized shade. One or more motorized shades can be controlled singly or as a group. In one embodiment, the motorized shades are used in connection with a zoned or non-zoned HVAC system to reduce energy usage. In one embodiment, the motorized shade is configured to have a size and form-factor that conforms to a standard manually-controlled motorized shade. In one embodiment, a group controller is configured to provide thermostat information to the motorized shade. In one embodiment, the group controller communicates with a central monitoring system that coordinates operation of one or more motorized shades. In one embodiment, the internal power source of the motorized shade is recharged by a solar cell.

10 Claims, 21 Drawing Sheets

U.S. PATENT DOCUMENTS 5,374,791 A 12/1994 LeMarchand
5,391,967 A 2/1995 Domel et al.
5,413,161 A 5/1995 Corazzini
5,414,334 A 5/1995 Cheron
5,429,558 A 7/1995 Lagarde
5,444,339 A 8/1995 Domel et al.
5,467,266 A * 11/1995 Jacobs et al. ..... 700/56
5,495,153 A 2/1996 Domel et al.
5,547,006 A 8/1996 Auger
5,603,368 A 2/1997 Colson et al.
5,603,369 A 2/1997 Colson et al.
5,621,295 A 4/1997 Vanderschaeghe et al.
5,645,118 A 7/1997 Lagarde
5,663,621 A * 9/1997 Popat ..... 318/480
5,698,958 A 12/1997 Domel et al.
5,718,799 A 2/1998 Colson et al.
5,749,404 A 5/1998 Colson
5,760,558 A * 6/1998 Popat ..... 318/480
5,793,174 A 8/1998 Kovach et al.
5,803,150 A 9/1998 Boiteau
5,847,525 A 12/1998 Cheron et al.
5,847,915 A 12/1998 Tranchand
5,848,634 A 12/1998 Will et al.
5,855,235 A 1/1999 Colson et al.
5,857,553 A 1/1999 Lagarde et al.
5,876,545 A 3/1999 Swiszcz et al.
5,907,277 A 5/1999 Domel et al.
5,909,093 A 6/1999 van Dinteren et al.
5,918,655 A 7/1999 Corey
5,969,492 A 10/1999 Motte et al.
5,973,472 A 10/1999 Orsat et al.
5,990,646 A 11/1999 Kovach et al.
5,990,653 A 11/1999 Orsat et al.
5,996,671 A 12/1999 Anderson et al.
6,001,199 A 12/1999 Colson et al.
6,006,812 A 12/1999 Corey
6,039,295 A 3/2000 de Beijer
6,056,036 A 5/2000 Todd et al.
6,057,658 A 5/2000 Kovach et al.
6,059,004 A 5/2000 Oskam
6,060,852 A 5/2000 Domel et al.
6,062,290 A 5/2000 Domel
6,066,382 A 5/2000 Swiszcz et al.
6,069,465 A 5/2000 de Boois et al.
6,072,265 A 6/2000 Grehant et al.
6,100,659 A * 8/2000 Will et al. ..... 318/466
6,104,156 A 8/2000 Bruno
6,111,376 A 8/2000 Jean-Marc
6,112,797 A 9/2000 Colson et al.
6,123,137 A 9/2000 Levert
6,159,875 A 12/2000 Jetzer et al.
6,161,607 A 12/2000 de Kimpe et al.
6,170,548 B1 1/2001 Swiszcz et al.
6,181,089 B1 1/2001 Kovach et al.
6,189,592 B1 2/2001 Domel
6,196,099 B1 3/2001 Marocco
6,201,364 B1 3/2001 Will et al.
6,234,233 B1 5/2001 Biro
6,244,532 B1 6/2001 Watanabe
6,253,822 B1 7/2001 Wootton
6,259,218 B1 7/2001 Kovach et al.
6,289,964 B1 9/2001 Colson et al.
6,298,273 B1 10/2001 Grehant et al.
6,299,115 B1 10/2001 Kovach et al.
6,302,182 B1 10/2001 Anderson
6,324,089 B1 11/2001 Symoen et al.
6,339,798 B1 1/2002 Cheron et al.
6,369,530 B2 4/2002 Kovach et al.
6,371,192 B1 4/2002 Anderson et al.
6,382,128 B1 5/2002 Colson et al.
6,382,294 B1 5/2002 Anderson et al.
6,392,374 B1 5/2002 Menetrier et al.
6,397,917 B1 6/2002 Levert
6,443,210 B1 9/2002 Welfonder
6,446,693 B1 9/2002 Anderson et al.
6,465,980 B1 10/2002 Orsat
6,484,069 B2 11/2002 Osinga
6,533,018 B2 3/2003 Anderson et al.
6,582,794 B1 6/2003 Fransen
6,629,481 B1 10/2003 Biro et al.
6,659,154 B2 12/2003 Bergeron et al.
6,666,252 B2 12/2003 Welfonder
6,668,982 B2 12/2003 LaGarde et al.
6,672,361 B2 1/2004 Fransen
6,680,594 B2 * 1/2004 Collett et al. ..... 318/280
6,688,368 B2 2/2004 Kovach et al.
6,688,369 B2 2/2004 Colson et al.
6,688,373 B2 2/2004 Corey et al.
6,708,750 B2 3/2004 Collett et al.
6,712,311 B2 3/2004 Colson et al.
6,712,747 B1 3/2004 Ballard
6,733,413 B2 5/2004 Lagarde et al.
6,736,186 B2 5/2004 Anderson et al.
6,761,782 B2 7/2004 Swiszcz et al.
6,778,416 B2 8/2004 Bruno
6,781,335 B2 8/2004 Osinga et al.
6,782,938 B2 8/2004 Colson et al.
6,786,268 B2 9/2004 Corey et al.
6,795,284 B2 9/2004 Bruno
6,808,001 B2 10/2004 Jelic et al.
6,810,620 B1 11/2004 Anderson et al.
6,812,662 B1 11/2004 Walker
6,814,129 B2 11/2004 Dupielet et al.
6,912,429 B1 * 6/2005 Bilger ..... 700/19
6,983,783 B2 * 1/2006 Carmen et al. ..... 160/120
7,111,952 B2 * 9/2006 Veskovic ..... 362/1
2004/0225379 A1 11/2004 Klasson et al.
2004/0250964 A1 * 12/2004 Carmen et al. ..... 160/120
2005/0269041 A1 * 12/2005 Anderson et al. ..... 160/121.1
2006/0021714 A1 * 2/2006 Carmen et al. ..... 160/120

FOREIGN PATENT DOCUMENTS

EP 1276250 A3 4/2003
WO 03083802 A2 10/2003
WO 03083802 A3 10/2003

OTHER PUBLICATIONS

Skyco Shading Systems, Inc., Somfy Electronics Catalog, Dec. 2002, 45 pages.
PSIB Installation & Programming, Dec. 2002, 7 pages.
BTX Installation Instructions for Motorized RS Roller Shade Systems, Sep. 2003, 16 pages.
Somfy Motor Catalog, Dec. 2003, 41 pages.

* cited by examiner

MOTORIZED WINDOW SHADE SYSTEM

BACKGROUND

1. Field of the Invention

The present invention relates to motorized window shades.

2. Description of the Related Art

A roll-up window shade is well known. The shade can be moved manually up or down in front of a window to control the light level, room temperature, light flow, or to provide privacy. The known roll-up shade is relatively inexpensive and is easy to install. If the shade is damaged, a new shade can be replaced easily. These types of shades are sold in retail stores and do-it-yourself centers across the U.S. The shades are typically stocked in 3, 4, 5 and 6 foot widths. The shade can easily be cut to the proper width with a cutting device either at the point of sale or at installation time. The installer or homeowner can measure and install the shade on the same site visit.

The conventional roll-up shade has a first pin end and a second spring end with a rectangular barb extending outwardly. The pin end is inserted into a circular hole in a bracket. The spring end is mounted in a similar shaped bracket with a slot designed to keep the barb from rotating. The brackets are designed to be mounted inside a window frame i.e., inside the jamb, or along the outside of a window frame. The user pulls the roll-up shade down by a hem bar located along the bottom edge of the shade until the desired amount of shade material is showing. The user then eases up on the hem bar until the pawl mechanism in the spring end of the shade locks the shade into position. As the shade is being pulled down, the spring is being wound up.

When the user wants to put the shade up, the user pulls down on the hem bar slightly to disengage the pawl mechanism and then guides the hem bar upward as the spring pulls the fabric upward. If the user lets go of the shade as the shade is traveling upward the spring in the shade will cause the shade to travel upward out of control. The hem bar will continue to rotate around the roller until it stops. The setting of multiple shades at the same relative position can be a very time consuming process. The manually-operated shades are not capable of receiving inputs from time clocks, photo sensors, occupant sensors or infrared hand held transmitters.

It is known to replace the spring mechanism described above with a motor, typically a tubular motor, to allow the window shade to be rolled and unrolled (opened and closed) by remote control. Installation of these systems typically requires a skilled craftsman. The installer usually will need to make one visit to measure the window and another separate visit to install the system. In some systems, the hem bar located at the bottom of the shade travels in channels secured to the sides of the window opening, thus, decreasing the amount of light that can enter through the window when the shade is up. The motor is typically connected to a nearby power source with line voltage or low-voltage wiring.

A typical motorized roller shade is secured to the window opening with two mounting brackets. The single roller shade is custom made with a fabric of choice. The motor is installed inside the roller tube at the factory and line or low voltage wiring connects the motor to a nearby power source. If the unit fails, the unit must typically be returned to the manufacturer or a technician must visit the job site.

Multiple units can be grouped together by wiring the multiple units to each other or to a common control system. Installation of such wiring is beyond the capabilities of most homeowners, and thus, such units must be installed by a professional installer.

The prior art devices generally suffer from a number of disadvantages including the inability to communicate with other devices, lack of intelligent control, e.g. by a microprocessor, and thus, having inability to be programmed easily, bulky size causing difficulty in installation, an unattractive appearance and maintenance problems as well as inability to easily retrofit to existing manually actuated shades. These problems have severely limited the market for motorized rollup window shades.

SUMMARY

The system and method disclosed herein solves these and other problems by providing a remotely-controllable, self-powered, user-installable motorized window shade. In one embodiment, the motorized roll-up window shade includes a controller, a tubular motor provided to the controller. The tubular motor is configured to raise and lower the window shade. A first power source is provided to the controller and a two-way wireless communication system is provided to the controller. The controller is configured to control the motor in response to a wireless communication received from a group controller or central control system. The motorized shades can be used to produce a desired room temperature during the day and to provide privacy at night.

In one embodiment, the electronically-controlled motorized shade includes a light sensor. In one embodiment, the electronically-controlled motorized shade includes a temperature sensor. In one embodiment, the electronically-controlled motorized shade includes a second power source. In one embodiment, the electronically-controlled motorized shade includes a solar cell configured to charge the first power source. In one embodiment, the electronically-controlled motorized shade includes a shade position sensor. In one embodiment, the electronically-controlled motorized shade includes a turns counter to count turns of the tubular motor.

In one embodiment, the controller is configured to transmit sensor data according to a threshold test. In one embodiment, the threshold test includes a high threshold level, a low threshold level, and/or a threshold range.

In one embodiment, the controller is configured to receive an instruction to change a status reporting interval. In one embodiment, the controller is configured to receive an instruction to change a wakeup interval. In one embodiment, the controller is configured to monitor a status of one or more electronically-controlled motorized shades.

In one embodiment, the controller is configured to communicate with a central controller. In one embodiment, the central controller communicates with an HVAC system. In one embodiment, the central controller is provided to a home computer. In one embodiment, the central controller is provided to a zoned HVAC system. In one embodiment, the central controller cooperates with the zoned HVAC system to use the motorized shade to partially control a temperature of a desired zone.

In one embodiment, the controller is configured to use a predictive model to compute a control program. In one embodiment, the controller is configured to reduce power consumption by the tubular motor. In one embodiment, the controller is configured to reduce movement of the tubular motor.

In one embodiment, a group controller is configured to use a predictive model to compute a control program for the motorized shade. In one embodiment, the group controller is configured to reduce power consumption by the motorized shade. In one embodiment, the group controller is configured to reduce movement of the motorized shade.

In one embodiment, the shade material includes a plurality of conductors provided to the controller. In one embodiment, the shade material includes a connector for connecting a charger to the controller to provide power to recharge the power source. In one embodiment, the shade material includes a solar cell.

In one embodiment, the motorized shade system can easily be installed by a homeowner or general handyman. In one embodiment, the motorized shade system is used in connection with a zoned or non-zoned HVAC system to control room temperatures throughout a building. The motorized shade can also be used in connection with a conventional zoned HVAC system to provide additional control and additional zones not provided by the conventional zoned HVAC system. The motorized shade can be installed in place of a conventional manually-controlled window treatment.

In one embodiment, the motorized shade includes an optical sensor to measure the ambient light either inside or outside the building. In one embodiment, the motorized shade opens if the light exceeds a first specified value. In one embodiment, the motorized shade closes if the light exceeds a second specified value. In one embodiment, the motorized shade is configured to partially open or close in order to maintain a relatively constant light level in a portion of the building.

In one embodiment, the motorized shade is powered by an internal battery. A battery-low indicator on the motorized shade informs the homeowner when the battery needs replacement. In one embodiment, one or more solar cells are provided to recharge the batteries when light is available.

In one embodiment, one or more motorized shades in a zone communicate with a group controller. The group controller measures the temperature of the zone for all of the motorized shades that control the zone. In one embodiment, the motorized shades and the group controller communicate by wireless communication methods, such as, for example, infrared communication, radio-frequency communication, ultrasonic communication, etc. In one embodiment, the motorized shades and the group controller communicate by direct wire connections. In one embodiment, the motorized shades and the group controller communicate using power-line communication.

In one embodiment, one or more group controllers communicate through a central controller.

In one embodiment, the motorized shade and/or the group controller includes an occupant sensor, such as, for example, an infrared sensor, motion sensor, ultrasonic sensor, etc. The occupants can program the motorized shade or the group controller to bring the zone to different temperatures when the zone is occupied or to provide privacy (e.g., by closing the shade) when the zone is occupied. In one embodiment, the occupants can program the motorized shade or the group controller to bring the zone to different temperatures and/or light levels depending on the time of day, the time of year, the type of room (e.g., bedroom, kitchen, etc.), and/or whether the room is occupied or empty. In one embodiment, various motorized shades and/or group controllers through a composite zone (e.g., a group of zones such as an entire house, an entire floor, an entire wing, etc.) intercommunicate and change the temperature setpoints according to whether the composite zone is empty or occupied.

In one embodiment, the home occupants can provide a priority schedule for the zones based on whether the zones are occupied, the time of day, the time of year, etc. Thus, for example, if zone corresponds to a bedroom and zone corresponds to a living room, zone can be given a relatively lower priority during the day and a relatively higher priority during the night. As a second example, if zone corresponds to a first floor, and zone corresponds to a second floor, then zone can be given a higher priority in summer (since upper floors tend to be harder to cool) and a lower priority in winter (since lower floors tend to be harder to heat). In one embodiment, the occupants can specify a weighted priority between the various zones.

DETAILED DESCRIPTION

Figure 1:
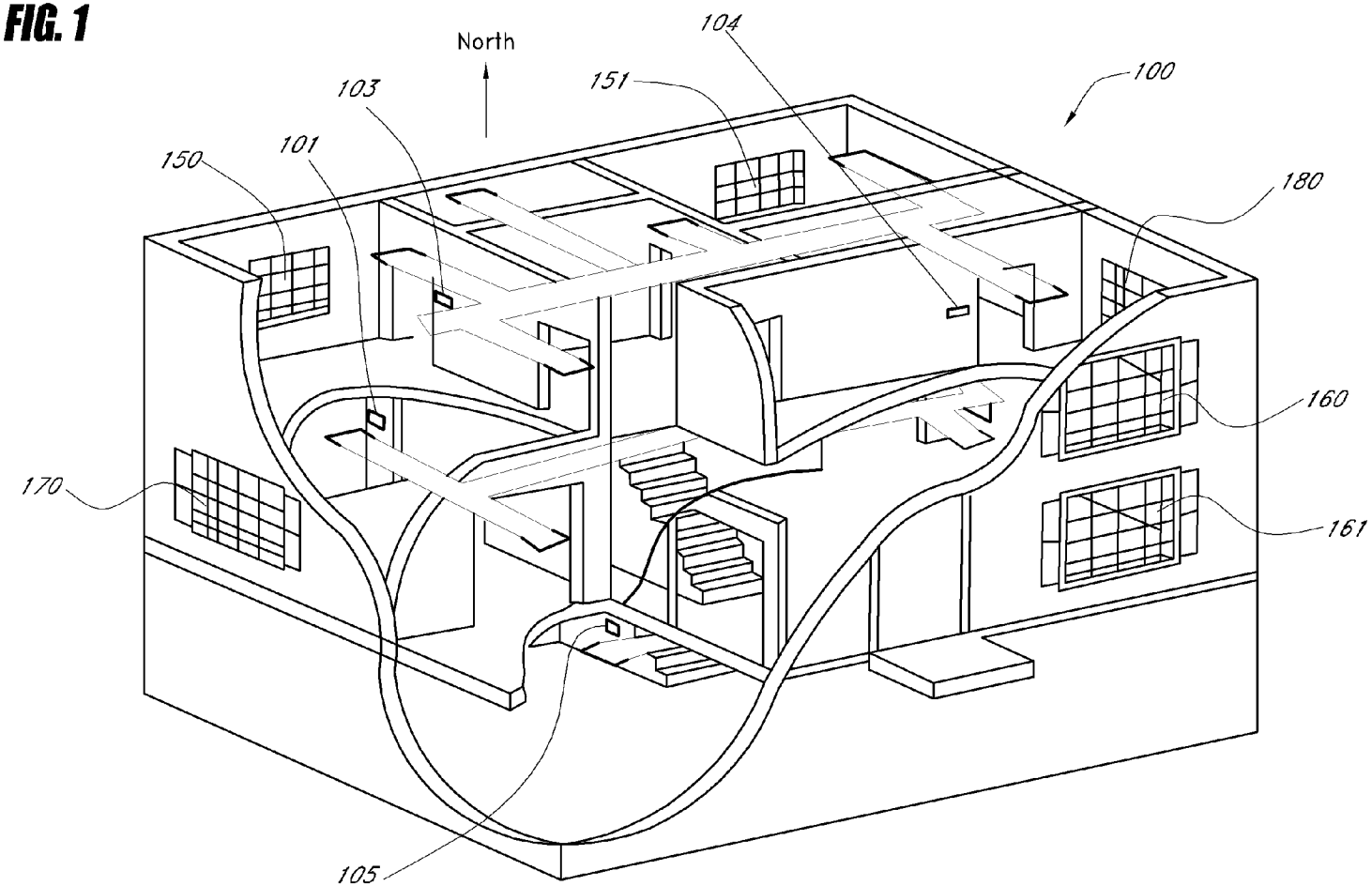
FIG. 1 shows a typical home with windows and ductwork for a heating and cooling system.

FIG. 1 shows a home 100 with ducts for heating and cooling and windows on various sides of the house. For example, the home 100 includes north-facing windows 150, 151, an east-facing window 180, south-facing windows 160, 161, and a west-facing window 170. In the home 100, an HVAC system provides heating and cooling light to the system of windows. In a conventional system, a thermostat monitors the air temperature and turns the HVAC system on or off. In a zoned system, sensors 101-105 monitor the temperature in various areas (zones) of the house. A zone can be a room, a floor, a group of rooms, etc. The sensors 101-105 detect where and when heating or cooling is needed. Information from the sensors 101-105 is used to control motors that adjust the flow of air to the various zones. The zoned system adapts to changing conditions in one area without affecting other areas. For example, many two-story houses are zoned by floor. Because heat rises, the second floor usually requires more cooling in the summer and less heating in the winter than the first floor. A non-zoned system cannot completely accommodate this seasonal variation. Zoning, however, can reduce the wide variations in temperature between floors by supplying heating or cooling only to the space that needs it.

Figure 2:
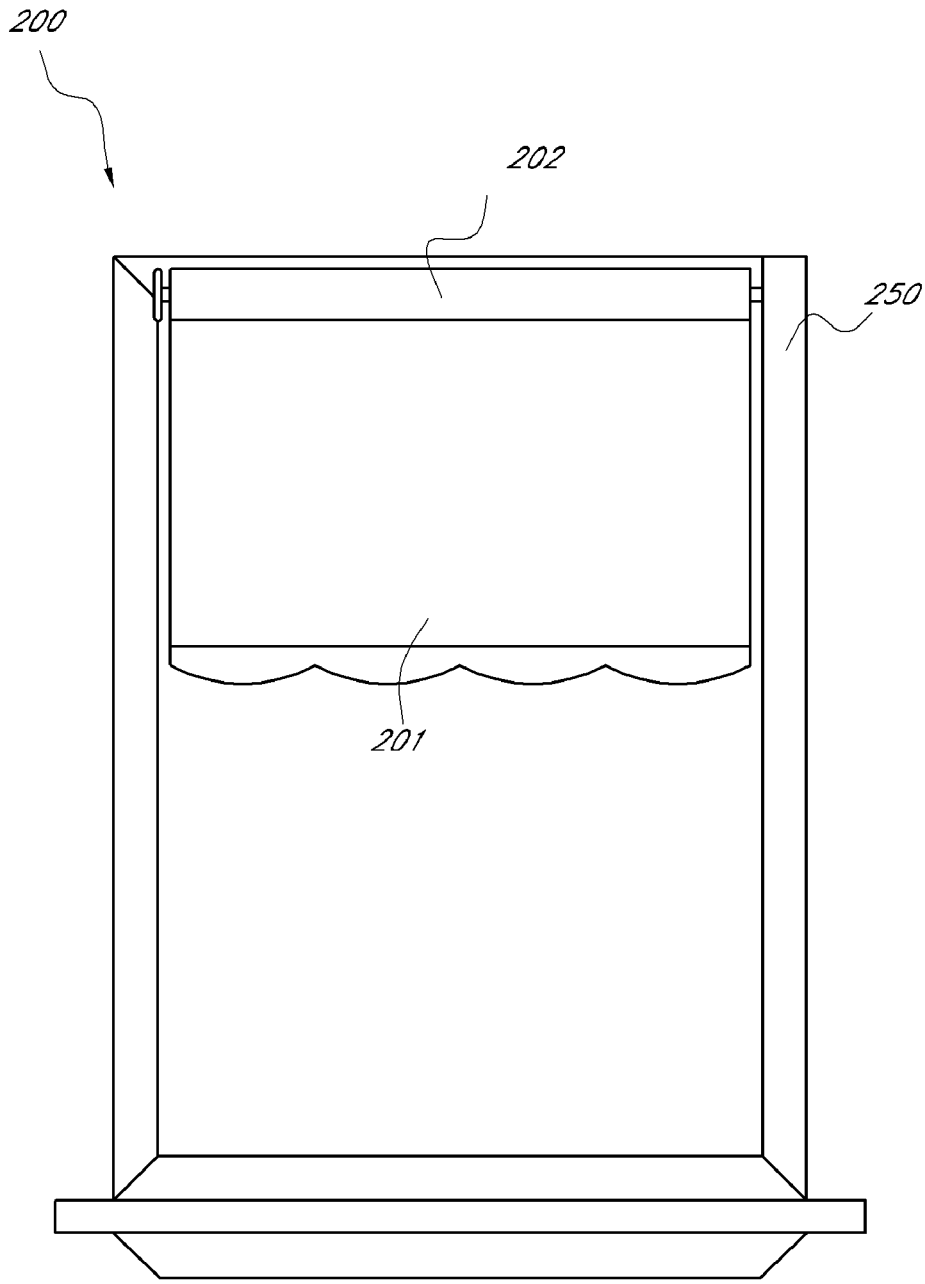
FIG. 2 shows one example of a motorized shade mounted in a window.

FIG. 2 shows one example of a motorized shade 200. The shade material 201 rolls on a tube 202. A motor (not shown) rotates the tube 202 to raise and lower the shade material 201 to control the amount of light that passes through the window. The tube 202 is mounted to (or near) a window frame 250.

Figure 3:
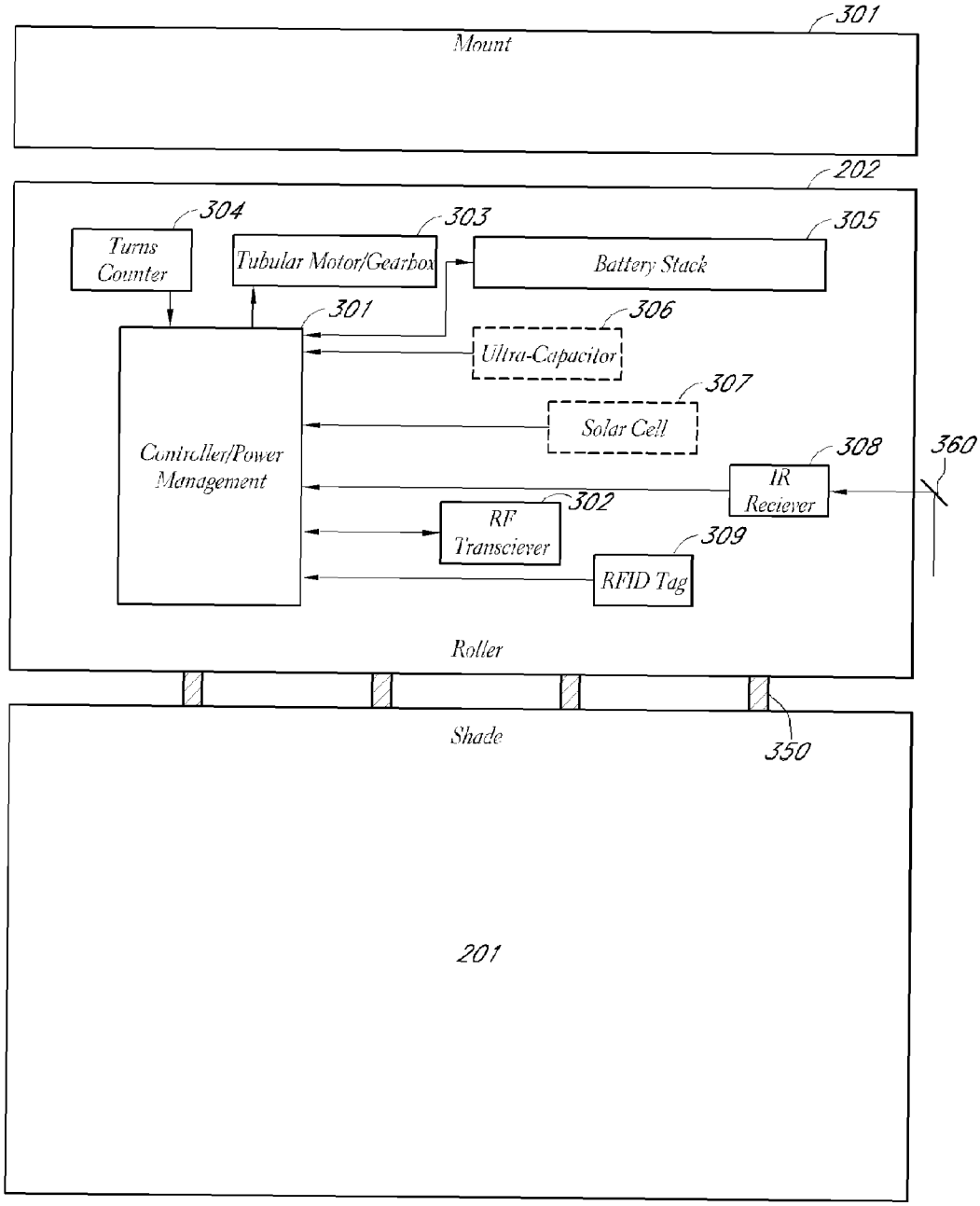
FIG. 3 is a block diagram of a self-contained motorized shade.

FIG. 3 is a block diagram of a self-contained motorized shade as one embodiment of the motorized shade 200. In the motorized shade shown in FIG. 3, a mount 301 mounts the tube 202 to the window frame 250 (or near the window frame 250). The tube 202 includes a controller 301. The controller 301 provides control for communications, power management, and other control functions. A motor 303, such as, for example, a tubular motor with a gearbox, is provided to the controller 301. In one embodiment, the motor 301 includes an internal turns counter and limit switches to limit the revolutions and set the stop points of the motor. In one embodiment, a turns counter 304 is provided to the controller 301. A first power source 305 is provided to the controller 301. In one embodiment, the first power source 305 includes a stack of batteries. In one embodiment, the batteries are rechargeable batteries. In one embodiment, the batteries are non-rechargeable batteries.

A radio-frequency transceiver 302 is provided to the controller. In one embodiment, an InfraRed (IR) and/or light sensor receiver is provided to the controller 301. In one embodiment, a light-guiding apparatus 360 is provided to direct light to the IR receiver 308. The light-guiding apparatus 360 can include, for example, a light-pipe, a mirror, a plastic light guide, etc. In one embodiment, at least a portion of the light-guiding apparatus 360 is provided to the mount 301 to reflect (or direct) IR light into the tube 202 and/or IR receiver 308.

In one embodiment, an optional capacitor 306 is provided to the controller 301. The controller 301 can extend the life of the first power source 305 by drawing power relatively slowly, and/or at relatively low voltage from the first power source 305 to charge the capacitor 306. In one embodiment, the capacitor 306 is used, at least in part, to provide power for the controller 301, the transceiver 302, and/or the motor 303.

In one embodiment, a solar cell 307 is provided to the controller 301. In one embodiment, an RFID tag 309 is provided to the controller 301.

In one embodiment, the IR receiver 308 is used to provide control inputs to the controller 301. In one embodiment, IR control is used in lieu of RF control, and the RF transceiver 302 is omitted. In one embodiment, the IR receiver 308 is configured as a transceiver to allow two-way IR communications between the motorized shade and a controller. In one embodiment, IR control is used for programming the controller 301 (e.g., for inserting or reading an identification code) and RF control is used to raise and lower the blinds.

One or more attachments 350 are provided to attach the shade material 201 to the roller tube 202. In one embodiment, the attachments 350 include a channel in the tube 202 and the upper end of the shade material 201 is configured to slide into the channel and be held in place by the channel. In one embodiment, the attachments 350 include one or more glue joints. In one embodiment, the attachments 350 include one or more capture devices that clamp onto the shade material.

In one embodiment, the shade material 201 includes one or more electrical conductors, such as, for example, (wires, wire meshes, metal foil, conductive polymers, etc.) In one embodiment, one or more of the attachments 350 are configured to make electrical contact with the one or more conductors in the shade material 201. In one embodiment a power connector is provided to the one or more conductors in the shade material to allow a power source (e.g., a battery charger) to be connected to the powered shade to recharge the batteries 305. In one embodiment, the power connector is provided to a lower portion of the shade material. In one embodiment, the one or more conductors in the shade material provide connections to power sources, such as, for example, solar cells (see e.g., FIG. 4*b*), pickup coils (see e.g., FIG. 10), etc.

In one embodiment, the tube 202 is made from aluminum or other conductive material, and a slot-type RF aperture is provided in the tube 202 to allow the RF transceiver 302 to communicate. In one embodiment, an RF antenna connection from the RF transceiver 302 is provided to the mount 301 to allow the mount and/or fascia to act as an antenna or portion of an antenna. In one embodiment, an RF antenna connection from the RF transceiver is provided to the tube 202 to allow the tube 202 to act as an antenna or portion of an antenna. In one embodiment, an RF antenna connection from the RF transceiver 302 is provided to one or more conductors in the shade material 301 to allow the one or more conductors to act as an antenna or portion of an antenna.

The controller 301 typically operates in a sleep-wakeup cycle to conserve power. The controller 301 wakes up at specified intervals and activates the transceiver 302 to listen for commands from a remote control or other control device or to send status information (e.g., fault, low battery, etc.).

Figure 4A:
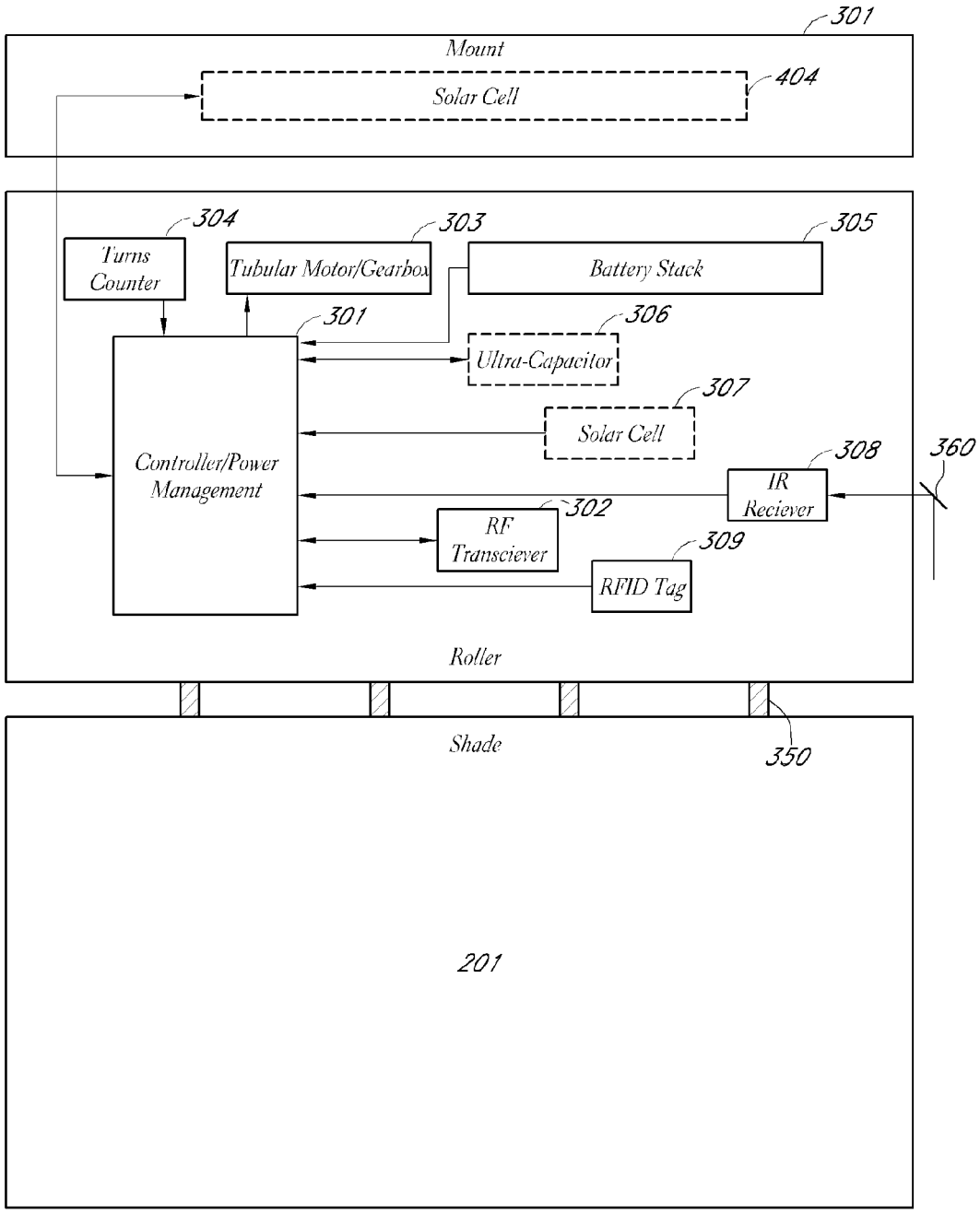
FIG. 4A is a block diagram of a motorized shade with a fascia having a solar cell.
Figure 5:
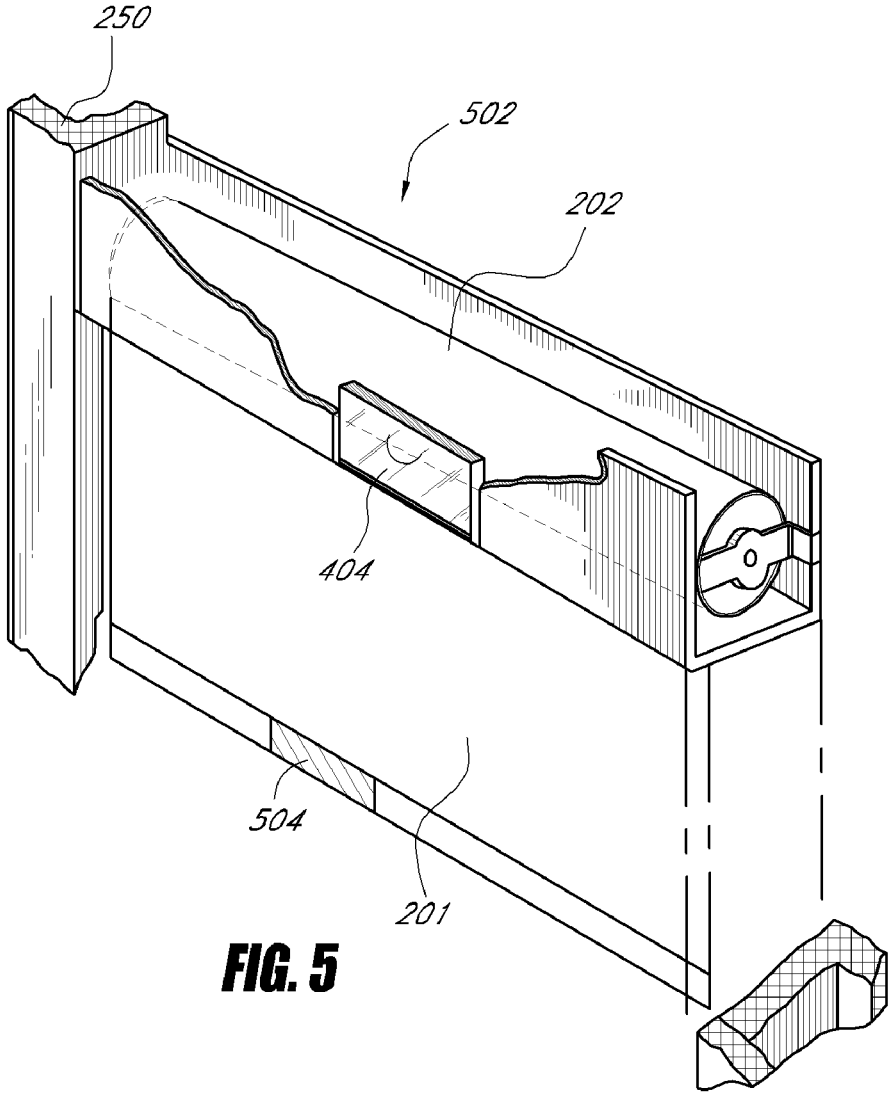
FIG. 5 shows one embodiment of a motorized shade with fascia having a solar cell.

FIG. 4A is a block diagram of an embodiment of a motorized shade as one embodiment of the motorized shade 200 that includes a solar cell 404 provided to the mount 301. In one embodiment, the mount 301 includes a fascia as shown in FIG. 5 and the solar cell 404 is mounted to the outside of the fascia in order to receive sunlight. The motorized shade shown in FIG. 4A includes the other elements shown in FIG. 3, including the tube 202, the controller 301, the motor 303, the transceiver 302, etc.

Figure 4B:
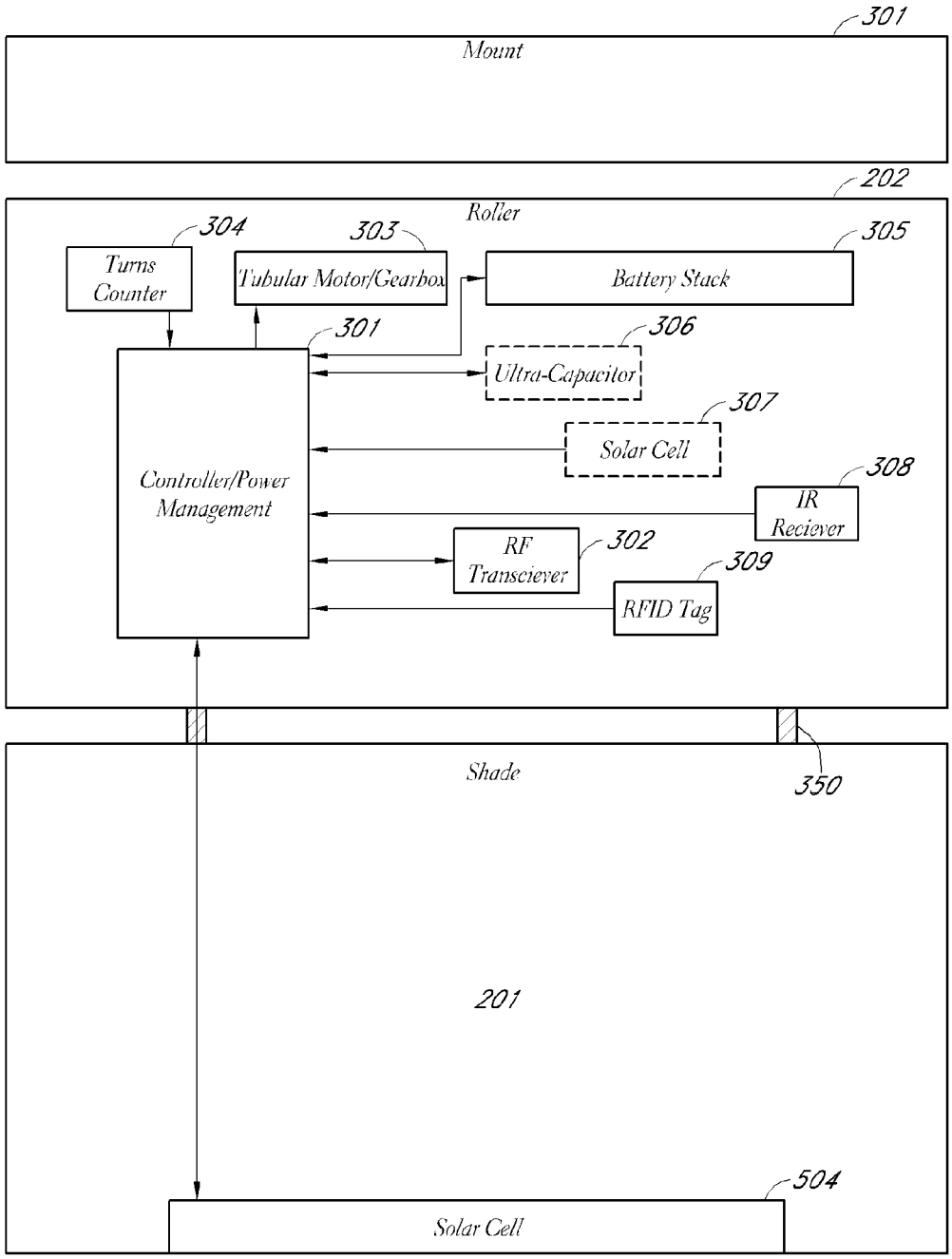
FIG. 4B is a block diagram of a motorized shade with a shade material having a solar cell.

FIG. 4B is a block diagram of an embodiment of a motorized shade as one embodiment of the motorized shade 200 that includes a solar cell 504 provided to the shade material 201. The solar cell 504 can be mounted to the shade material 201 and/or integrated into the shade material 201. When the solar cell 504 is provided to the shade material 201, then one or more of the attachments 350 are configured to provide electrical contact between the controller 301 and the solar cell 504.

FIG. 5 shows one embodiment of a motorized shade with the solar cell 404 provided to a fascia 502. As shown in FIG. 5, the solar cells 404 and 504 are not mutually exclusive and can be used together if desired.

Figure 6:
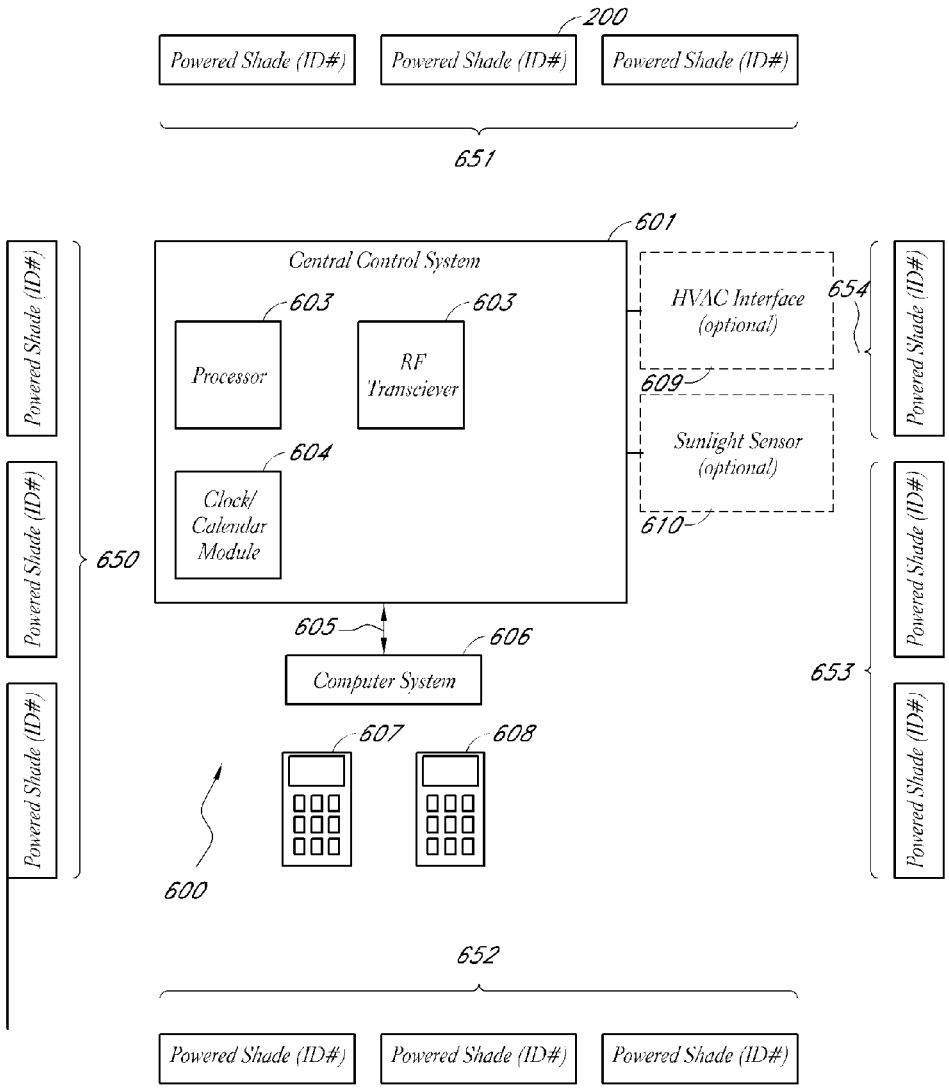
FIG. 6 is a block diagram of a system for controlling one or more motorized shades.

FIG. 6 is a block diagram of a system for controlling one or more motorized shades 200. The system 600 allows the motorized shades 200 to be controlled in groups (where a group can be one motorized shade or a plurality of motorized shades). FIG. 6 shows five groups of motorized shades, labeled groups 650-654. Groups 650-652 each have three or more motorized shades, group 653 has two shades, and group 654 has one motorized shade. One or more group controllers 607, 608 can be used to control one or more groups of shades. The group controllers 607, 608 can be hand-held remote-control type devices and/or wall-mounted controllers. A central control system 601 includes a processor 603, a clock/calendar module 604, and an RF transceiver 602. In one embodiment, the central control system 601 is provided to an HVAC interface to a zoned or non-zoned HVAC system. In one embodiment, a sunlight sensor 610 is provided to the control system 601. In one embodiment, the sunlight sensor 610 detects the amount of sunlight. In one embodiment the sunlight sensor 610 detects the amount and direction of the sunlight.

One or more group controllers 607, 608 can be provided to various rooms in the house, such as for example, the bedrooms, kitchen, living room, etc. In one embodiment, the controllers 607, 608 can be used to control any of the shades in the house. In one embodiment, a display on the group controller 607, 608 allows the user to select which group of shades to control from a list of shade groups.

The central control system 601 is provided to a computer system (e.g., a personal computer system) by an interface 605 such as, for example, a USB interface, a firewire interface, a wired local area network (LAN) interface, a wireless local area network interface, a powerline networking interface, etc. The computer system 606 can be used to program and monitor the central control system 601 and to instruct the control system 601 as to the number of motorized shades, the identification codes for the shades, the location of the shades, the amount of privacy desired, how to interact with the HVAC system, etc. For example, if a window faces the street or other public areas, then the computer system 606 can be used to instruct the central control system 601 to provide a relatively high level of privacy for that window. By contrast, if a window faces a barrier of trees or bushes, then the computer system 606 can be used to instruct the central control system 601 to provide a relatively lower level of privacy for that window.

In one embodiment, a compass direction of each window (e.g., south facing, northwest facing, compass angle of the direction the window faces, etc.) corresponding to a motorized shade is provided to the central control system 601. Thus, for example, the control system 601 will know that south-facing windows receive relatively more sunlight than north-facing windows. The central control system 601 can close the shades on south-facing windows in order to reduce cooling and reduce fading of carpets and furniture caused by sunlight. Alternatively, the central control system 601 can open the shades on south-facing windows in order to reduce heating loads during cold periods. In one embodiment, the central control system 601 can open the motorized shades during the day to let in sunlight, and close the motorized shades during the night to provide privacy. In one embodiment, the central controller 601 is configured to partially open or close the motorized shades to let in a desired amount of light. In one embodiment, the central controller 601 is configured to open and close shades in a particular group by the same amount for aesthetic purposes.

In one embodiment, the group controllers 607, 608 can be used to control one or more groups of motorized shades. In one embodiment, the group controllers 607, 608 send control signals directly to the motorized shades. In one embodiment, the group controllers 607, 608 send control signals to the central controller 601 which then sends control signals to the motorized shades 200.

The motorized shades 200 can be used to implement a motorized shade system. The motorized shades 200 can also be used as a remotely control motorized shade in places where the window is located so high on the wall that it cannot be easily reached. In one embodiment, the motorized shades 200 are self-powered and controlled by wireless communication. This greatly simplifies the task of retrofitting a home by replacing one or more manual window treatments with the motorized shades 200.

The controller 301 controls the motor 303. In one embodiment, the motor 303 provides position feedback to the controller 301. In one embodiment, the controller 301 reports shade position to the central control system 601 and/or group controllers 607, 608. The motor 303 provides mechanical movements to control the light through the window. In one embodiment, the motor 303 includes a motor to control the amount of light that flows through the motorized shade 400 (e.g., the amount of light that flows from the window into the room). In one embodiment, the system 601 allows a user to set the desired room temperature and/or lighting. An optional sensor 404 is provided to the controller 301.

In one embodiment, the motorized shade 200 includes a flashing indicator (e.g., a flashing LED or LCD) when the available power from the power source 305 drops below a threshold level.

The home occupants use the group controllers 607, 608 or computer 606 to set a desired temperature, privacy, or lighting for the vicinity of the motorized shade 200. If the room temperature is above the setpoint temperature, and the window light temperature is below the room temperature, then the controller 301 causes the motorized shade 200 to open the shade. If the room temperature is below the setpoint temperature, and the window light temperature is above the room temperature, then the controller 301 causes the motorized shade 200 to open the window. Otherwise, the controller 301 causes the motorized shade 200 to close the shade. In other words, if the room temperature is above or below the setpoint temperature and the temperature of the light in the window will tend to drive the room temperature towards the setpoint temperature, then the controller 301 opens the window to allow light into the room. By contrast, if the room temperature is above or below the setpoint temperature and the temperature of the light in the window will not tend to drive the room temperature towards the setpoint temperature, then the controller 301 closes the window.

In one embodiment, the controller 301 is configured to provide a few degrees of hysteresis (often referred to as a thermostat deadband) around the setpoint temperature in order to avoid wasting power by excessive opening and closing of the window.

The controller 301 conserves power by turning off elements of the motorized shade 400 that are not in use. The controller 301 monitors power available from the power sources 305, 306. When available power drops below a low-power threshold value, the motorized shade 200 informs the central controller 601. When the controller senses that sufficient power has been restored (e.g., through recharging of one or more of the power sources, then the controller 301 resumes normal operation).

In one embodiment, the motorized shades 200 communicates with each other in order to improve the robustness of the communication in the system. Thus, for example, if a first motorized shade is unable to communicate with the group controller 601 but is able to communicate with a second motorized shade 200, then the second motorized shade 200 can act as a repeater between the first motorized shade 200 and the group controller 601.

The motorized shade system shown in FIG. 6 can be used in connection with a zoned or non-zoned HVAC system. For example, in winter, the system 600 can be used to open the shades of southerly windows on sunny days to provide some measure of solar heating. By contrast, in winter, the system 600 can be used to close the window shades windows in the evening in order to reduce heat loss and to provide privacy. For example, in winter, the system 600 can be used to close the shades of southerly windows on sunny days to reduce solar heating. By contrast, in summer, the system 600 can be used to open the window shades windows in the evening in order to radiate heat (reducing cooling loads).

Using the system 600, the homeowner can select the relative priority of light, temperature, and privacy for each group of shades. The relative priorities can be adjusted based on day of the week, time of day, time of year, etc. In one embodiment, the system 600 is provided with an override switch (not shown) to change the relative priorities (e.g., temperature, privacy, light) based on whether the homeowner is at home or away from home. Thus, for example, while away from home, the homeowner can instruct the system 600 to minimize privacy and maximize HVAC efficiency; by contrast, when at home, the homeowner can instruct the system 600 to use different priorities that provide relatively more privacy.

In one embodiment, the user can use the computer system 606 to specify the relative desired privacy, temperature, and light levels, and the relative priorities of privacy, temperature, and light, for each group of shades in the house. In one embodiment, the settings can be specified as a matrix of settings according to the day of the week and/or the hour of the day and/or the time of year, etc.

In one embodiment, the user can create various "profiles" using the computer system. Thus, for example, the user can create a privacy profile, a summer profile, a morning profile, and evening profile, a default profile, a standard profile, a winter profile, etc. Thus, for example, the user can create a privacy profile wherein the various settings of the shade control system are adjusted to provide relatively more privacy. The user can create a summer profile wherein the various settings of the shade control system are adjusted to provide setting the user desires during summer (e.g., efficient use of cooling). The user can create a winter profile wherein the various settings of the shade control system are adjusted to provide settings the user desires during winter (e.g., efficient use of heating). In one embodiment, the system comes configured with a default profile that is configured to provide a balance of privacy, temperature, and light, summer cooling, winter heating, evening privacy, etc. In one embodiment, the default profile is computed by the shade control system according to the geographical location of the house.

In one embodiment, the control system 601 is an adaptive system (as shown, for example in FIG. 17) configured to learn and adapt. Thus, for example, the control system 601, when provided with temperature data from a room corresponding to particular group of shades, can adapt to change in room temperature as that group of shades is raised and lowered.

In one embodiment, the user can create a standard profile that includes the user's standard desired settings for the system. The use of profiles allows the user to quickly and easily change the many operating parameters of the shade control system (e.g., using the controls 607, 608) on a group-by-group, room-by-room basis, or on a whole-house basis.

Figure 7A:
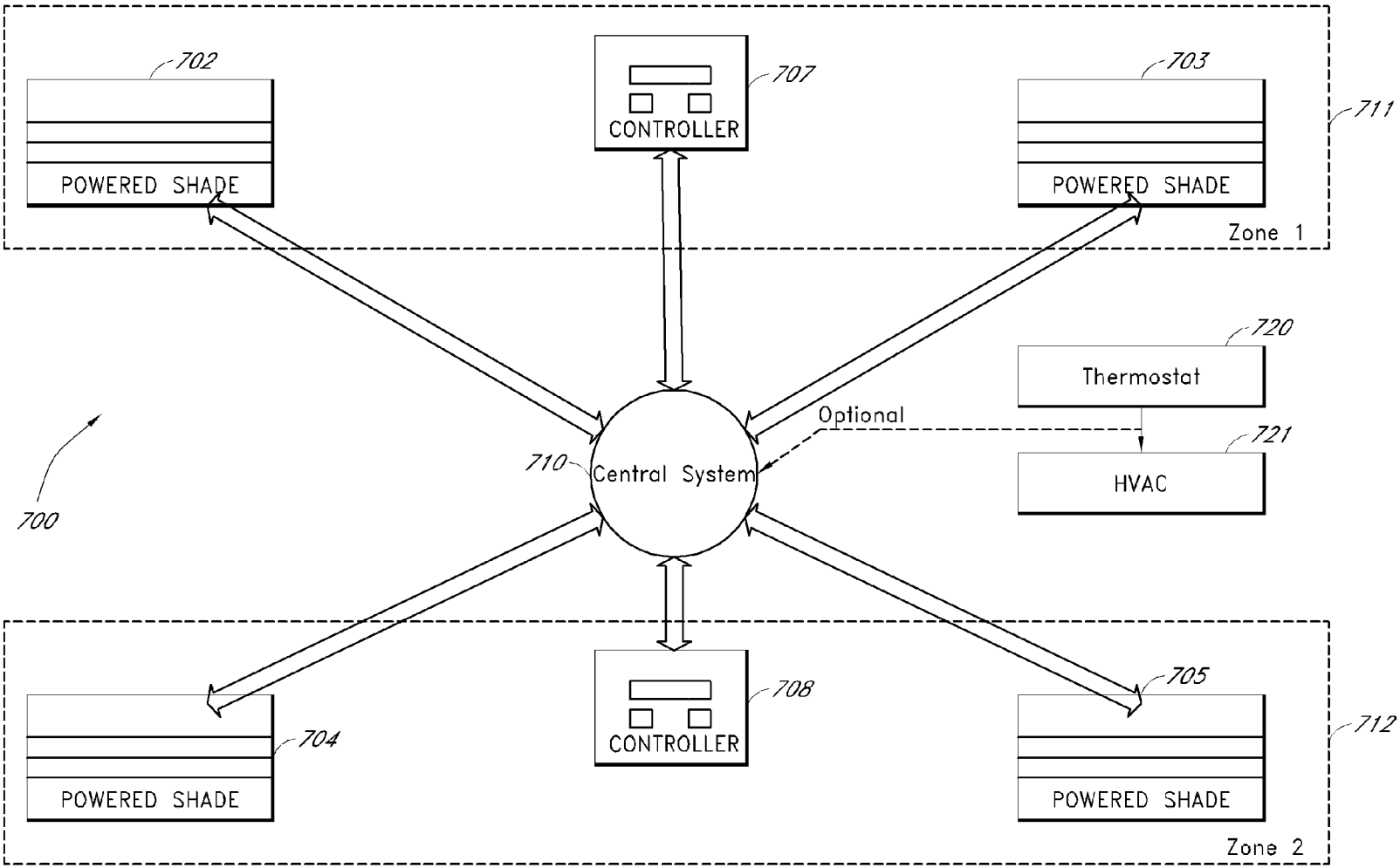
FIG. 7A is a block diagram of a centrally-controlled motorized shade system wherein the central control system communicates with one or more group controllers and one or more motorized shades independently of the HVAC system.

Any number of independent groups can be controlled by the system 600. FIG. 7A is a block diagram of a centrally-controlled zoned heating and cooling system wherein a central control system 710 communicates with one or more group controllers 707 708 and one or more motorized shades 702-705. In the system 700, the group controller 707 measures the temperature and/or light of a zone 711, and the motorized shades 702, 703 are used to regulate light to the zone 711. The group controller 708 measures the temperature and/or light of a zone 712, and the motorized shades 704, 705 regulate light to the zone 712. A central thermostat 720 controls the HVAC system 721.

Figure 7B:
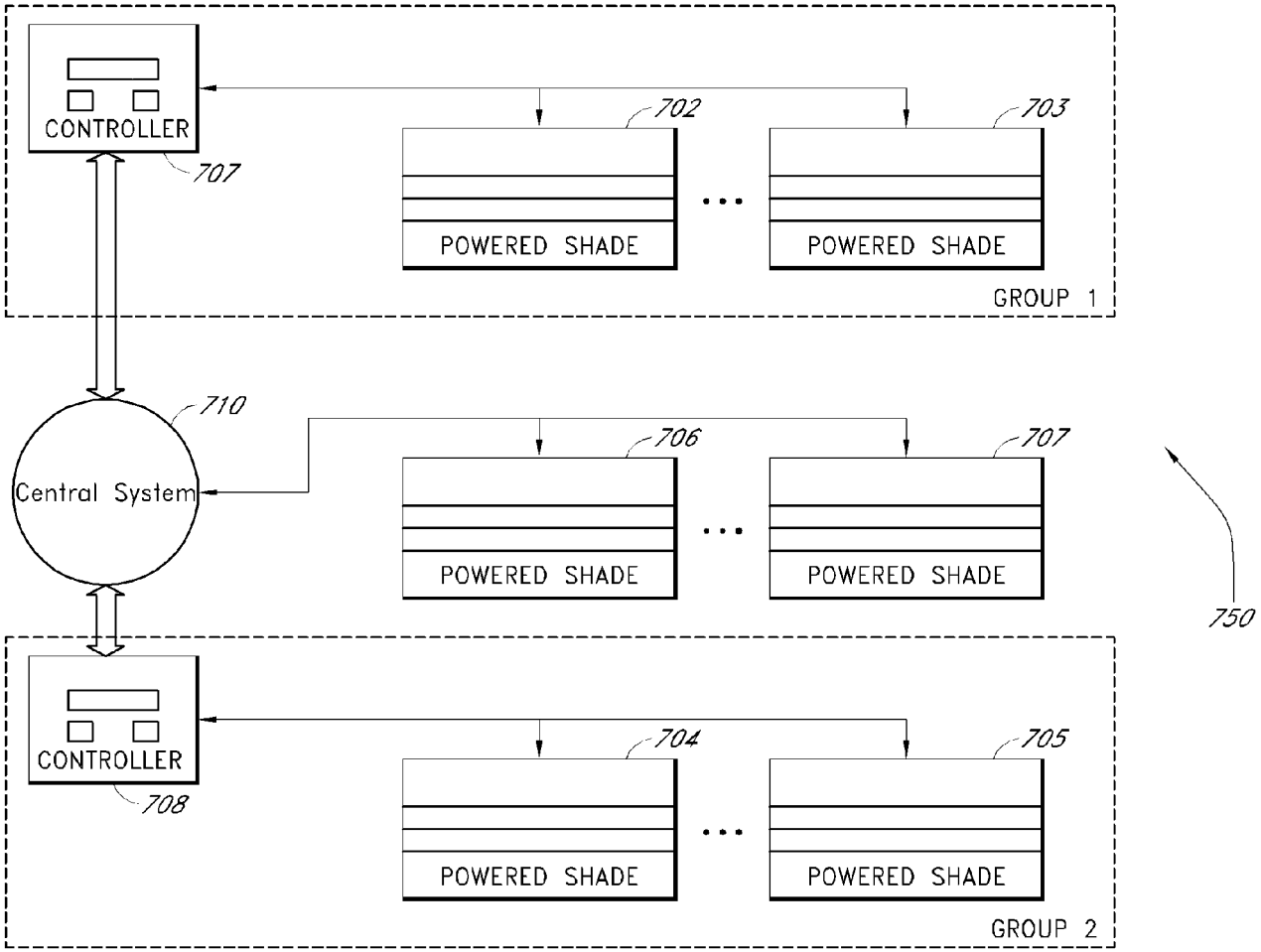
FIG. 7B is a block diagram of a centrally-controlled motorized shade system wherein the central control system communicates with one or more group controllers and the group controllers communicate with one or more motorized shades.

FIG. 7B is a block diagram of a centrally-controlled motorized shade system 750 that is similar to the system 700 shown in FIG. 7A. In FIG. 7B, the central system 710 communicates with the group controllers 707, 708, the group controller 707 communicates with the motorized shades 702, 703, the group controller 708 communicates with the motorized shades 704, 705, and the central system 710 communicates with the motorized shades 706, 707. In the system 750, the motorized shades 702-705 are in zones that are associated with the respective group controller 707, 708 that controls the respective motorized shades 702-705. The motorized shades 706, 707 are not associated with any particular group controller and are controlled directly by the central system 710. One of ordinary skill in the art will recognize that the communication topology shown in FIG. 7B can also be used in connection with the system shown in FIGS. 8 and 9.

The central system 710 an example of one embodiment of the central control system 601. The central system 710 controls and coordinates the operation of the zones 711 and 712, but the system 710 does not control the HVAC system 721. In one embodiment, the central system 710 operates independently of the thermostat 720. In one embodiment, the thermostat 720 is provided to the central system 710 so that the central system 710 knows when the thermostat is calling for heating, cooling, or fan.

The central system 710 coordinates and prioritizes the operation of the motorized shades 702-705. In one embodiment, the home occupants and provide a priority schedule for the zones 711, 712 based on whether the zones are occupied, the time of day, the time of year, etc. Thus, for example, if zone 711 corresponds to a bedroom and zone 712 corresponds to a living room, zone 711 can be given a relatively lower priority during the day and a relatively higher priority during the night. As a second example, if zone 711 corresponds to a first floor, and zone 712 corresponds to a second floor, then zone 712 can be given a higher priority in summer (since upper floors tend to be harder to cool and have different privacy requirements) and a lower priority in winter (since lower floors tend to be harder to heat and my require less privacy). In one embodiment, the occupants can specify a weighted priority between the various zones.

Figure 8:
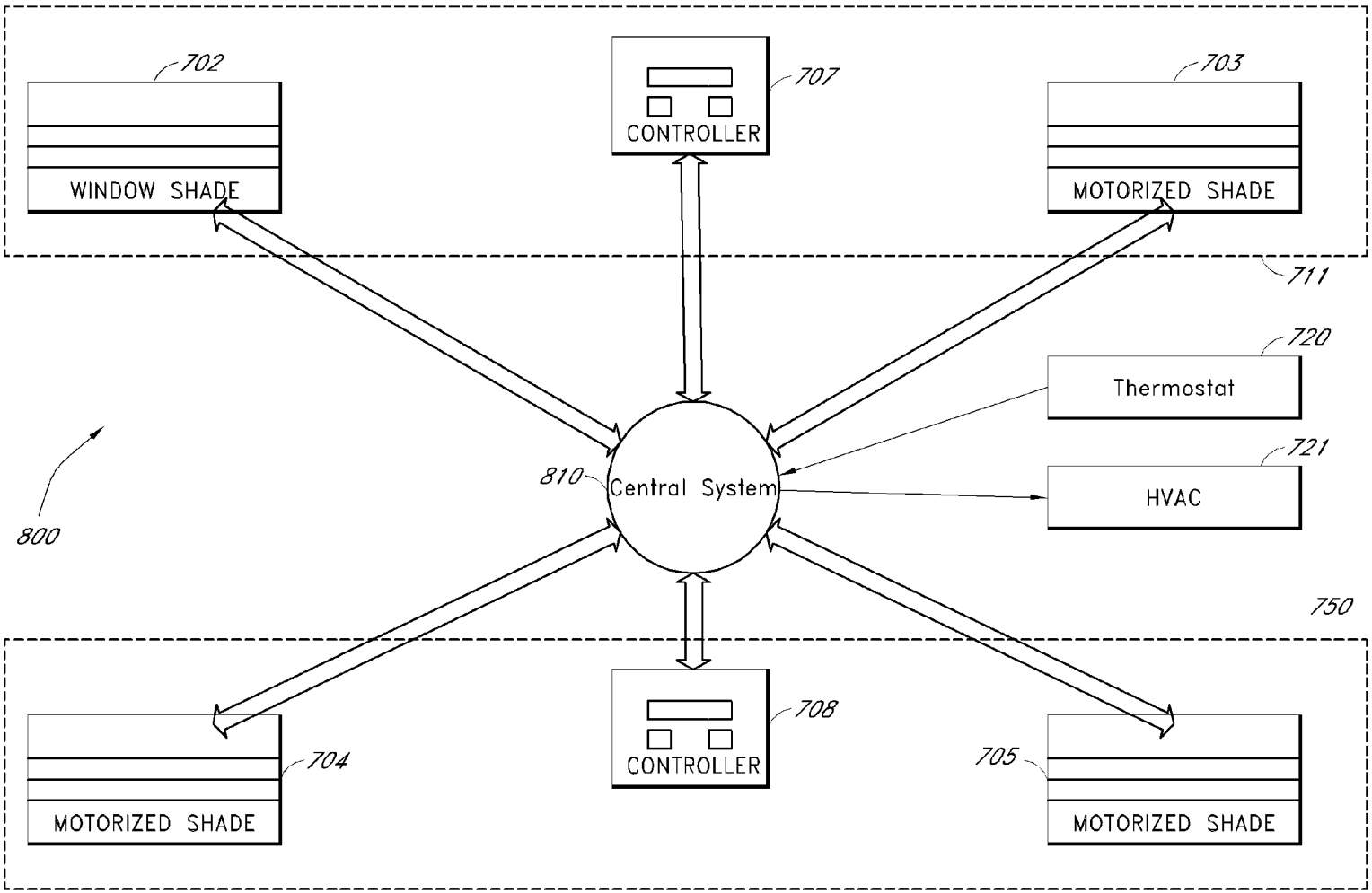
FIG. 8 is a block diagram of a centrally-controlled motorized shade system wherein a central control system communicates with one or more group controllers and one or more motorized shades and, optionally, controls the HVAC system.

FIG. 8 is a block diagram of a centrally-controlled motorized shade system 800. The system 800 is similar to the system 700 and includes the group controllers 707, 708 to monitor the zones 711, 712, respectively, and the motorized shades 702-705. The group controllers 707, 708 and/or the motorized shades 702-705 communicate with a central controller 810. In the system 800, the thermostat 720 is provided to the central system 810 and the central system 810 controls the HVAC system 721 directly. The central system 810 an example of one embodiment of the central control system 601.

Since the controller in FIG. 8 also controls the operation of the HVAC system 721, the controller is better able to call for heating and cooling as needed to maintain the desired temperature of the zones 711, 712. If all, or substantially, all of the home is served by the group controllers and motorized shades, then the central thermostat 720 can be eliminated.

Figure 9:
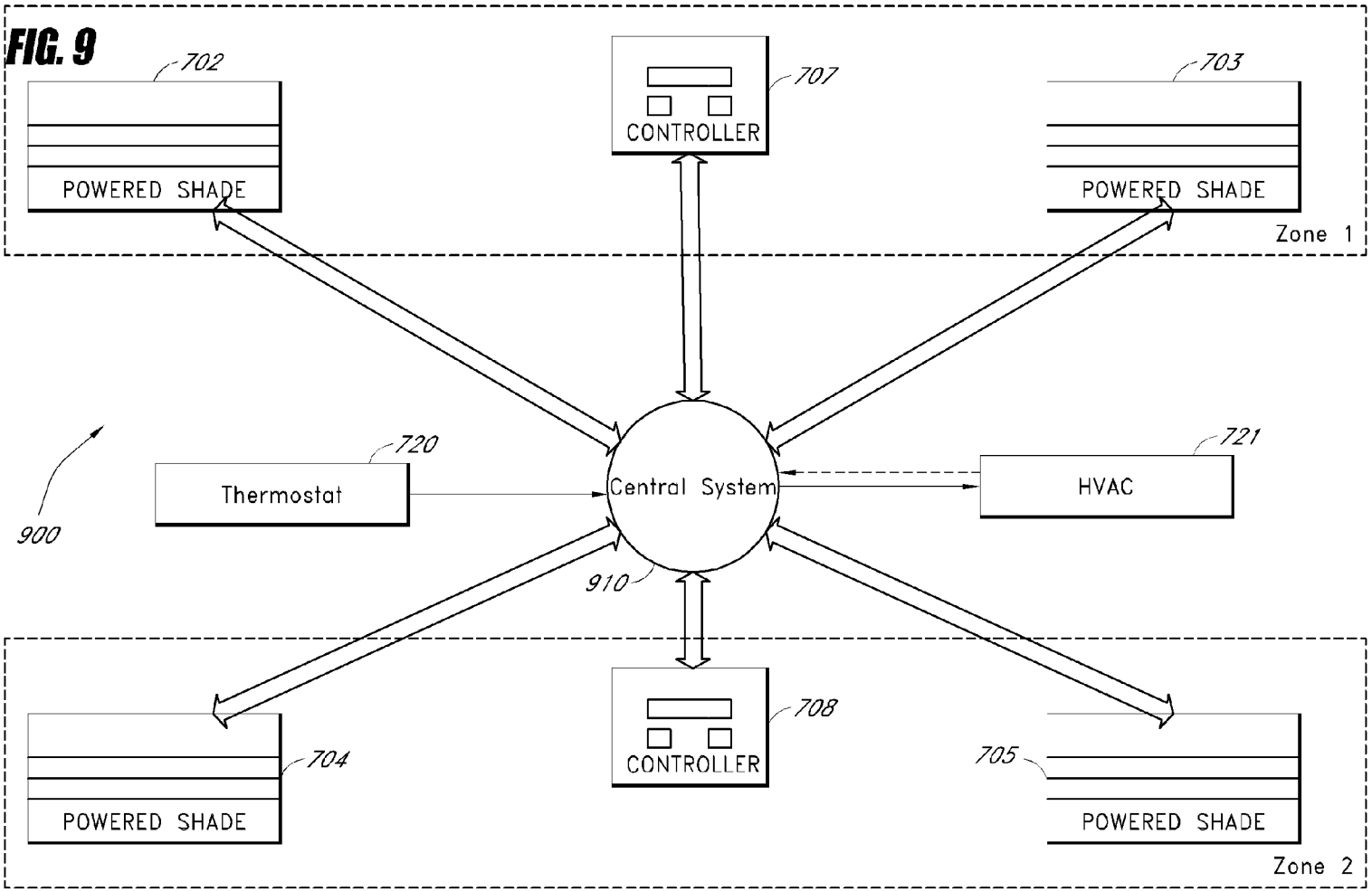
FIG. 9 is a block diagram of an efficiency-monitoring centrally-controlled motorized shade system wherein a central control system communicates with one or more group controllers and one or more motorized shades and, optionally, controls and monitors the HVAC system.

FIG. 9 is a block diagram of an efficiency-monitoring centrally-controlled motorized shade system 900. The system 900 is similar to the system 800. In the system 900, a controller 910 includes an efficiency-monitoring system that is configured to receive sensor data (e.g., system operating temperatures, etc.) from the HVAC system 721 to monitor the efficiency of the HVAC system 721. The central system 910 an example of one embodiment of the central control system 601.

Figure 10:
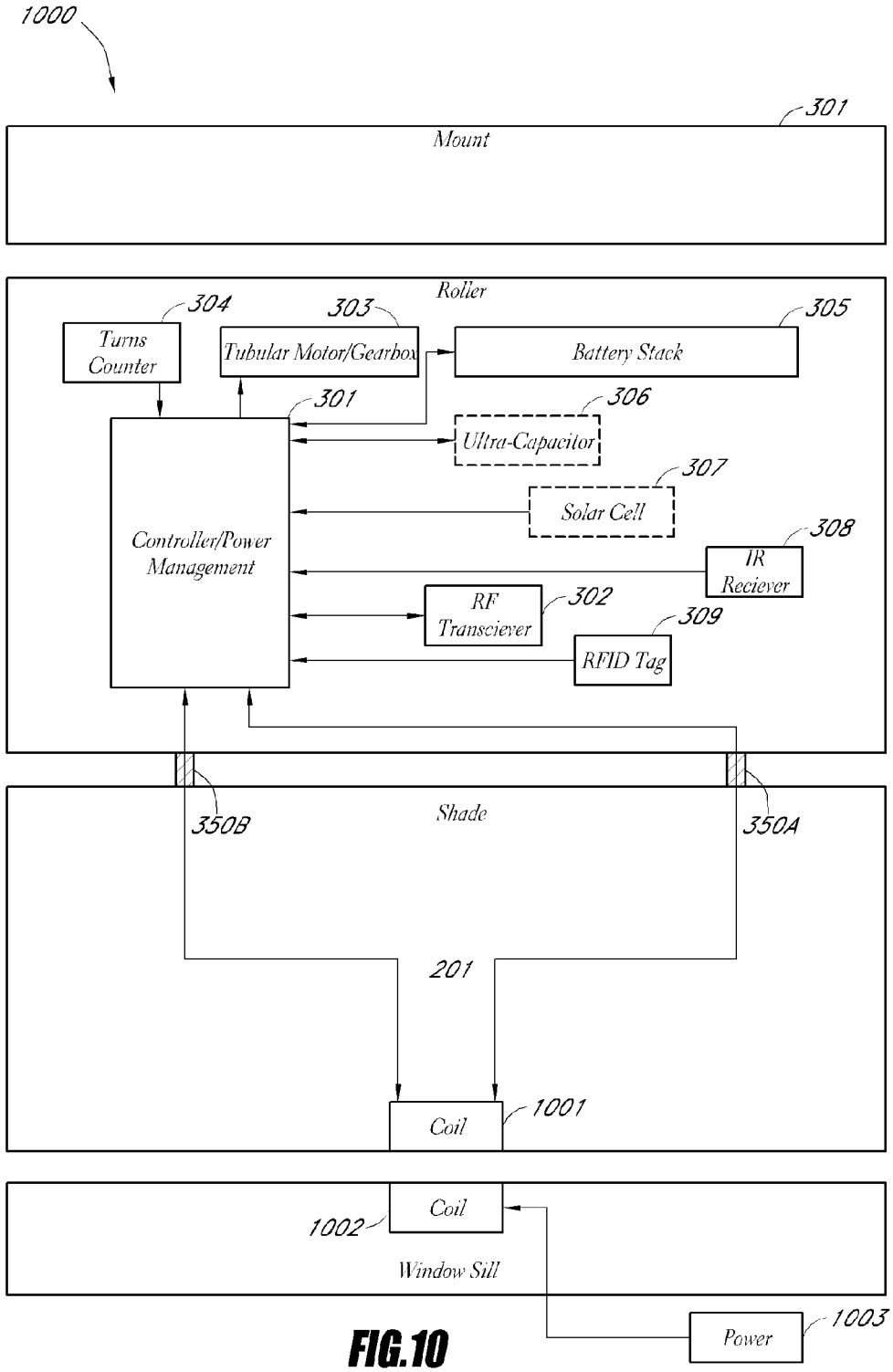
FIG. 10 is a block diagram of a motorized shade configured to operate with a powered coil mounted on a window sill.

FIG. 10 is a block diagram of a motorized shade 1000 configured to operate with a powered coil mounted on a window sill. The motorized shade 1000 is one embodiment of the motorized shade 200. The motorized shade 1000 includes the elements shown in FIG. 3, and, in addition, the motorized shade 1000 includes a coil 1001. The coil 1001 is provided to the controller 301. In one embodiment, the coil 1001 is provided to the controller 301 through a conductive coupling 350*a* and a conductive coupling 350*b*. A powered coil 1002 is provided to a window sill such that when the shade 1000 is lowered to the window sill, the coil 1001 is in proximity to the coil 1002. In one embodiment, alternating current power is provided to the coil 1002 from a power source 1003. In one embodiment, the power source 1003 is provided to a wall outlet to receive standard household AC power. When the shade lowered, the coil 1001 electromagnetically couples to the coil 1002 to form a transformer such that power is provided from the coil 1002 to the coil 1001. The power received by the coil 1001 is provided to the controller 301 and the controller 301 can store the received power in the optional capacitor 306 or in a rechargeable battery 305. In one embodiment, one or both of the coils 1001, 1002 include a core of magnetic material. In one embodiment, the magnetic field produced by the powered coil 1002 attracts the magnetic core of the coil 1001 to help hold the bottom of the shade material in place.

In one embodiment, the coil 1002 is continuously powered by the power source 1003. In one embodiment, the controller 301 sends a pulse of power to the coil 1001, which pulse is then coupled to the coil 1002 and provided by the coil 1002 to the power source 1003. The power source 1003, upon sensing the pulse from the controller 301, then provides power to the coil 1002 in response to the power pulse from the controller 301. In one embodiment, the controller 301 sends a second pulse to the coil 1001 to instruct the controller 1003 to depower the coil 1002.

In one embodiment, the power source 1003 senses the impedance of the coil 1002 (on a continuous or periodic basis) and provides power to the coil 1002 when the impedance of the coil 1002 indicates that the coil 1001 is in proximity to the coil 1002.

Power provided to the coil 1002 will magnetically attract a magnetic core of the coil 1001. In one embodiment, the motor 303 can provide sufficient torque to overcome such magnetic attraction and raise the shade. In one embodiment, the controller 301 sends a reverse current pulse to the coil 1001 to cause the magnetic field of the coil 1001 to substantially cancel the magnetic field of the coil 1002 in order to release the shade and allow the shade to then be raised by the motor 303.

In one embodiment, the controller 301 automatically lowers the shade 1000 when available power from the battery pack 305 and/or capacitor 306 falls below a specified value. In one embodiment, the system controllers (e.g., the controllers 710, 810, 910, etc.) instruct the controller 301 to lower the shade 1000 when the available power from the battery pack 305 and/or capacitor 306 falls below a specified value.

In one embodiment, a plurality of coils 1001 and/or 1002 are provided along the lower portion of the shade material 201 and the window sill respectively.

Figure 11:
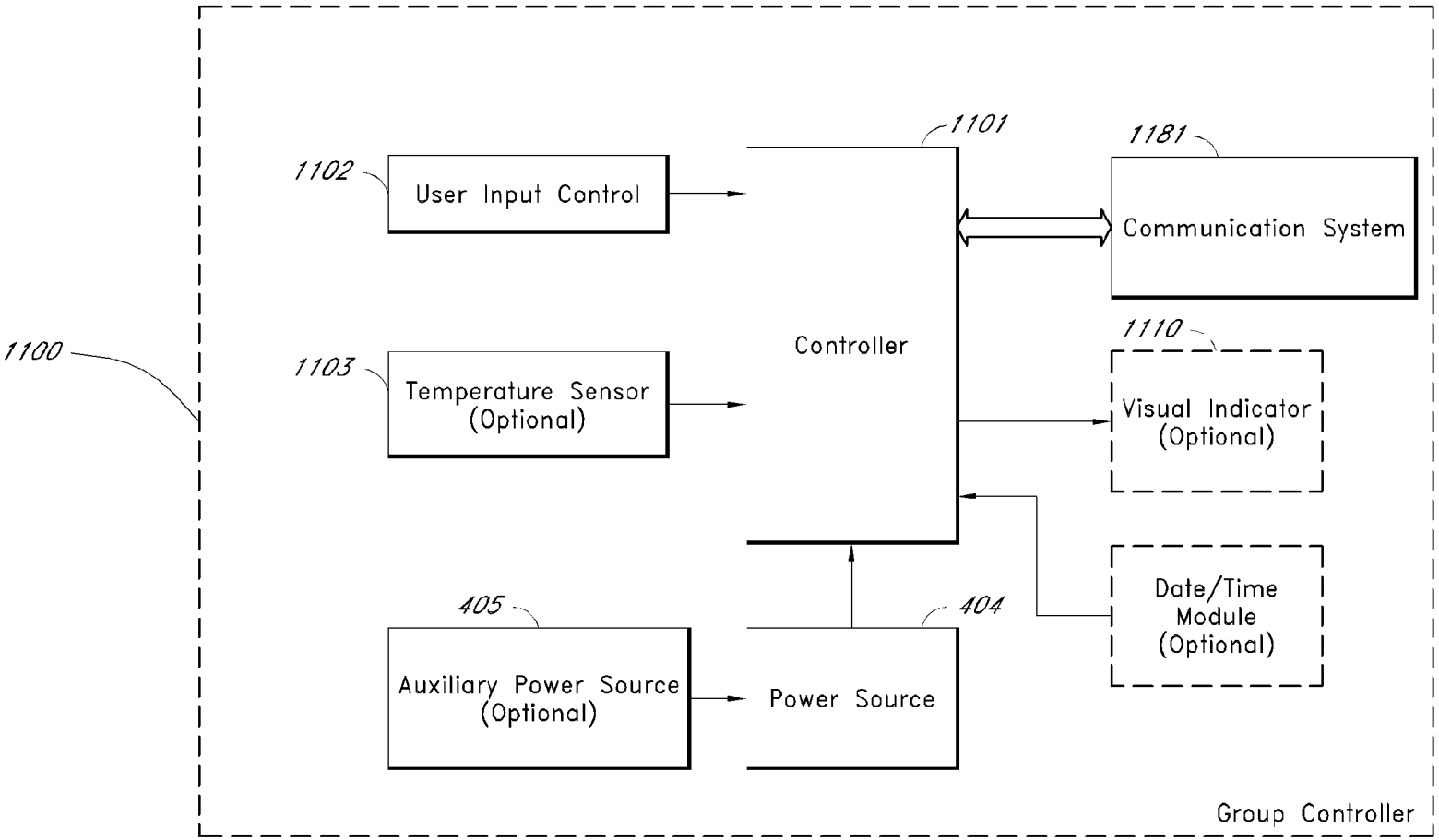
FIG. 11 is a block diagram of a basic group controller for use in connection with the systems shown in FIGS. 6-9.

FIG. 11 is a block diagram of a basic group controller 1100 for use in connection with the systems shown in FIGS. 6-9. In the group controller 1100, an optional temperature sensor 1102 is provided to a controller 1101. User input controls 1103 are also provided to the controller 1101 to allow the user to select a shade and specify a setpoint shade opening. A visual display 1110 is provided to the controller 1101. The controller 1101 uses the visual display 1110 to show the current shade group, setpoint, power status, etc. The communication system 1181 is also provided to the controller 1101. The power source 404 and, optionally, 405 are provided to provide power for the controller 1100, the controls 1101, the sensor 1103, the communication system 1181, and the visual display 1110.

In systems where the central controller 1101 is used, the communication method used by the group controller 1100 to communicate with the motorized shade 1000 need not be the same method used by the group controller 1100 to communicate with the central controller 1101. Thus, in one embodiment, the communication system 1181 is configured to provide one type of communication (e.g., infrared, radio, ultrasonic) with the central controller, and a different type of communication with the motorized shade 1000.

In one embodiment, the group controller is battery powered. In one embodiment, the group controller is configured into a standard light switch and receives electrical power from the light switch circuit.

Figure 12:
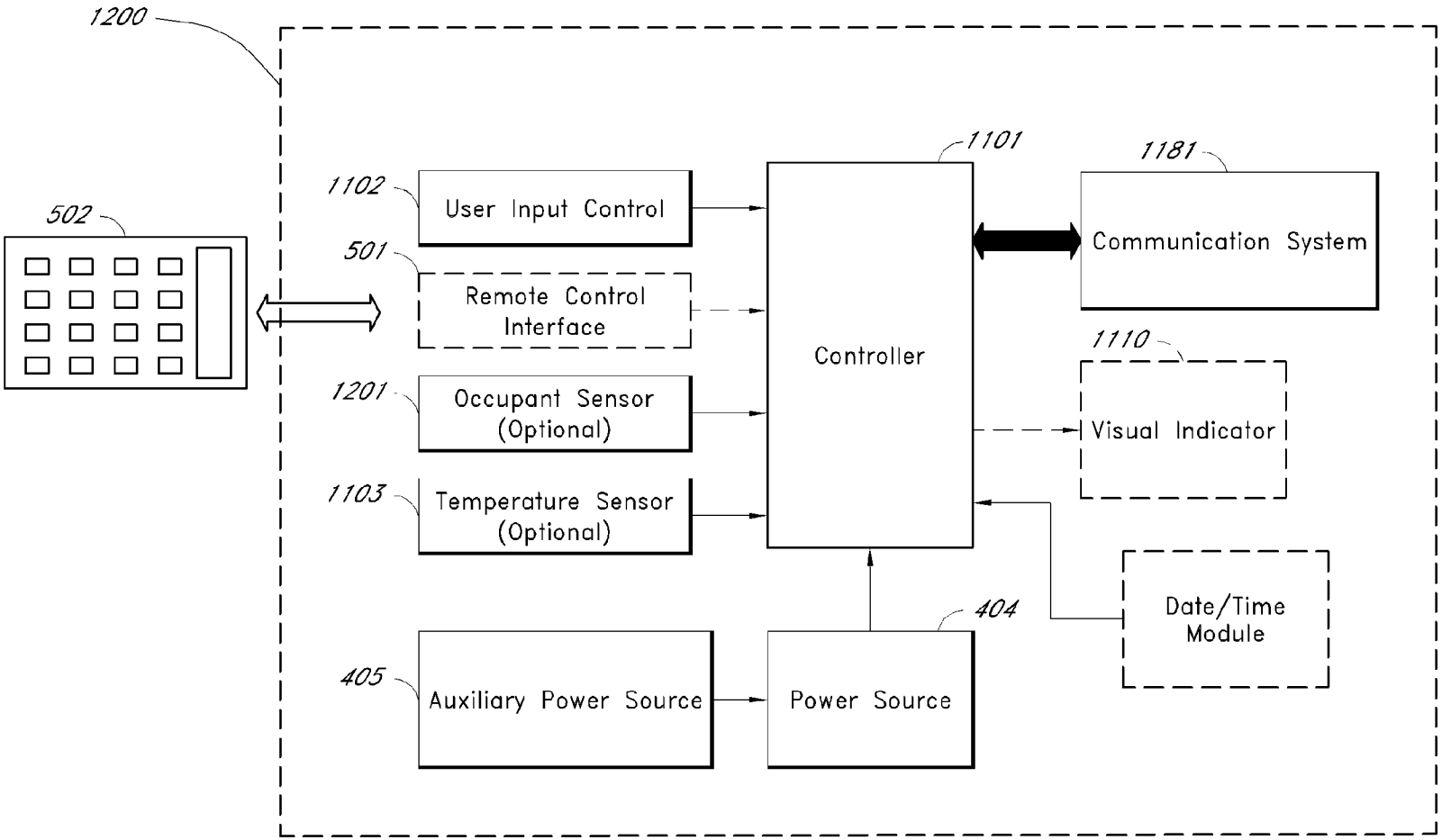
FIG. 12 is a block diagram of a group controller with remote control for use in connection with the systems shown in FIGS. 6-9.

FIG. 12 is a block diagram of a group controller 1200 with remote control for use in connection with the systems shown in FIGS. 6-9. The group controller 1200 is similar to the group controller 1100 and includes, the temperature sensor 1103, the input controls 1102, the visual display 1110, the communication system 1181, and the power sources 404, 405. In the group controller 1200, the remote control interface 501 is provided to the controller 1101.

In one embodiment, an occupant sensor 1201 is provided to the controller 1101. The occupant sensor 1201, such as, for example, an infrared sensor, motion sensor, ultrasonic sensor, etc., senses when the zone is occupied. The occupants can program the group controller 1101 to bring the zone to different temperatures and privacy levels when the zone is occupied and when the zone is empty. In one embodiment, the occupants can program the group controller 1101 to bring the zone to different temperatures or privacy levels depending on the time of day, the time of year, the type of room (e.g. bedroom, kitchen, etc.), and/or whether the room is occupied or empty. In one embodiment, a group of zones are combined into a composite zone (e.g., a group of zones such as an entire house, an entire floor, an entire wing, etc.) and the central system 601, 810, 910 changes the temperature setpoints of the various zones according to whether the composite zone is empty or occupied.

Figure 13:
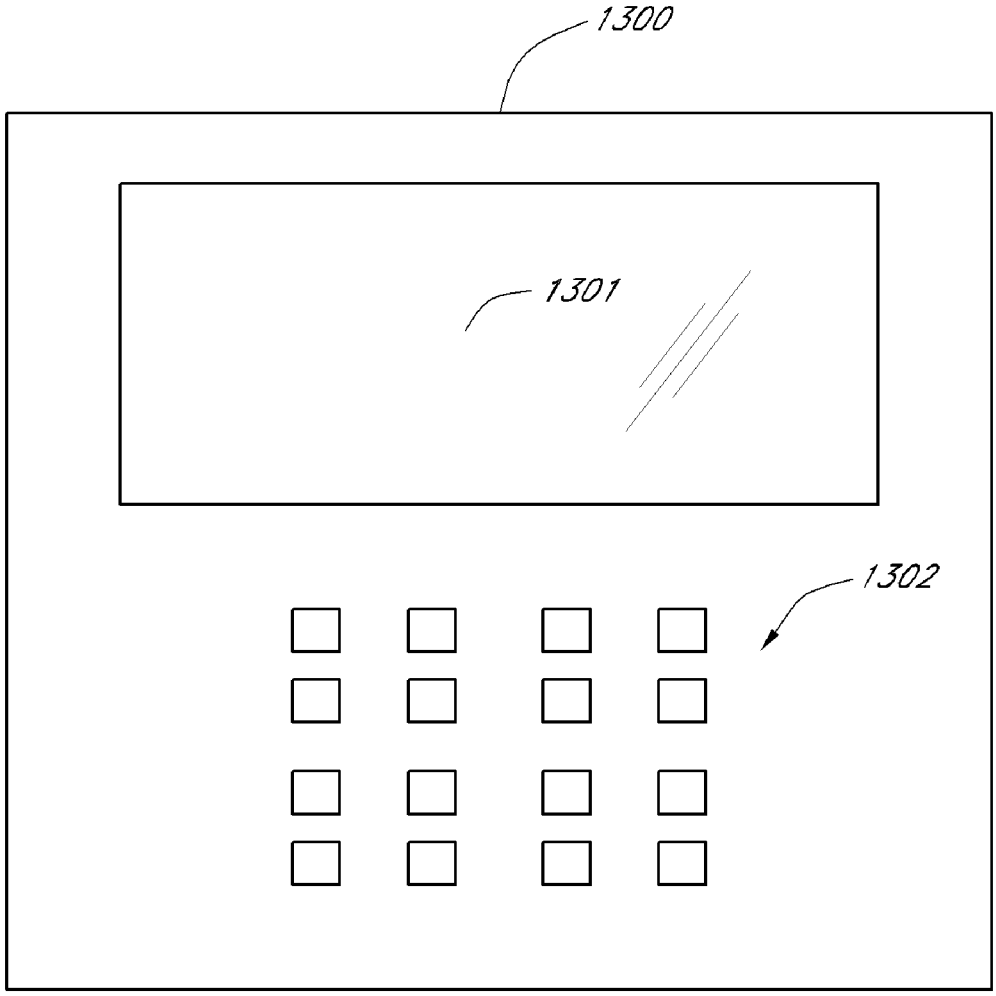
FIG. 13 shows one embodiment of a central monitoring system.

FIG. 13 shows one embodiment of a central monitoring station console 1300 for accessing the functions represented by the blocks 601, 710, 810, 910 in FIGS. 6, 7, 8, 9, respectively. The station 1300 includes a display 1301 and a keypad 1302. The occupants can specify light level settings, privacy levels, etc using the central system 1300 and/or the group controllers. In one embodiment, the console 1300 is implemented as a hardware device. In one embodiment, the console 1300 is implemented in software as a computer display, such as, for example, on a personal computer. In one embodiment, the zone control functions of the blocks 710, 810, 910 are provided by a computer program running on a control system processor, and the control system processor interfaces with personal computer to provide the console 1300 on the personal computer. In one embodiment, the zone control functions of the blocks 710, 810, 910 are provided by a computer program running on a control system processor provided to a hardware console 1300. In one embodiment, the occupants can use the Internet, telephone, cellular telephone, pager, etc. to remotely access the central system to control the temperature, priority, etc. of one or more zones.

Figure 14:
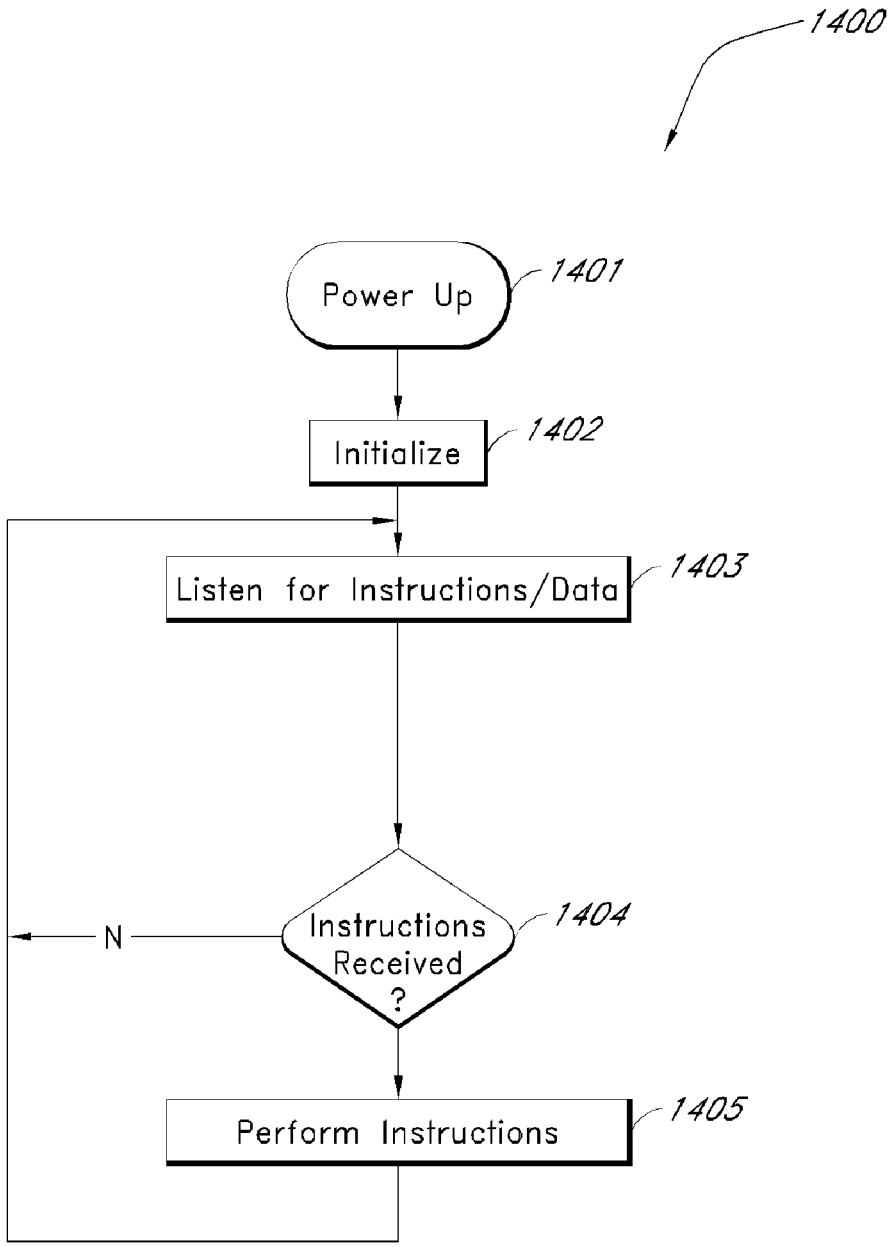
FIG. 14 is a flowchart showing one embodiment of an instruction loop for a motorized shade or group controller.

FIG. 14 is a flowchart showing one embodiment of an instruction loop process 1400 for a motorized shade or group controller. The process 1400 begins at a power-up block 1401. After power up, the process proceeds to an initialization block 1402. After initialization, the process advances to a "listen" block 1403 wherein the motorized shade or group controller listens for one or more instructions. If a decision block 1404 determines that an instruction has been received, then the process advances to a "perform instruction" block 1405, otherwise the process returns to the listen block 1403.

For a motorized shade, the instructions can include: open window, close window, open window to a specified partially-open position, report sensor data (e.g., light level, shade position, etc.), report status (e.g., battery status, window position, etc.), and the like. For a group controller, the instructions can include: report light sensor data, report status, etc. In systems where the central system communicates with the motorized shades through a group controller, the instructions can also include: report number of motorized shades, report motorized shade data (e.g., status, position, light, etc.), report motorized shade window position, change motorized shade window position, etc.

In one embodiment, the listen block 1403 consumes relatively little power, thereby, allowing the motorized shade or group controller to stay in the loop corresponding to the listen block 1403 and conditional branch 1404 for extended periods of time.

Figure 15:
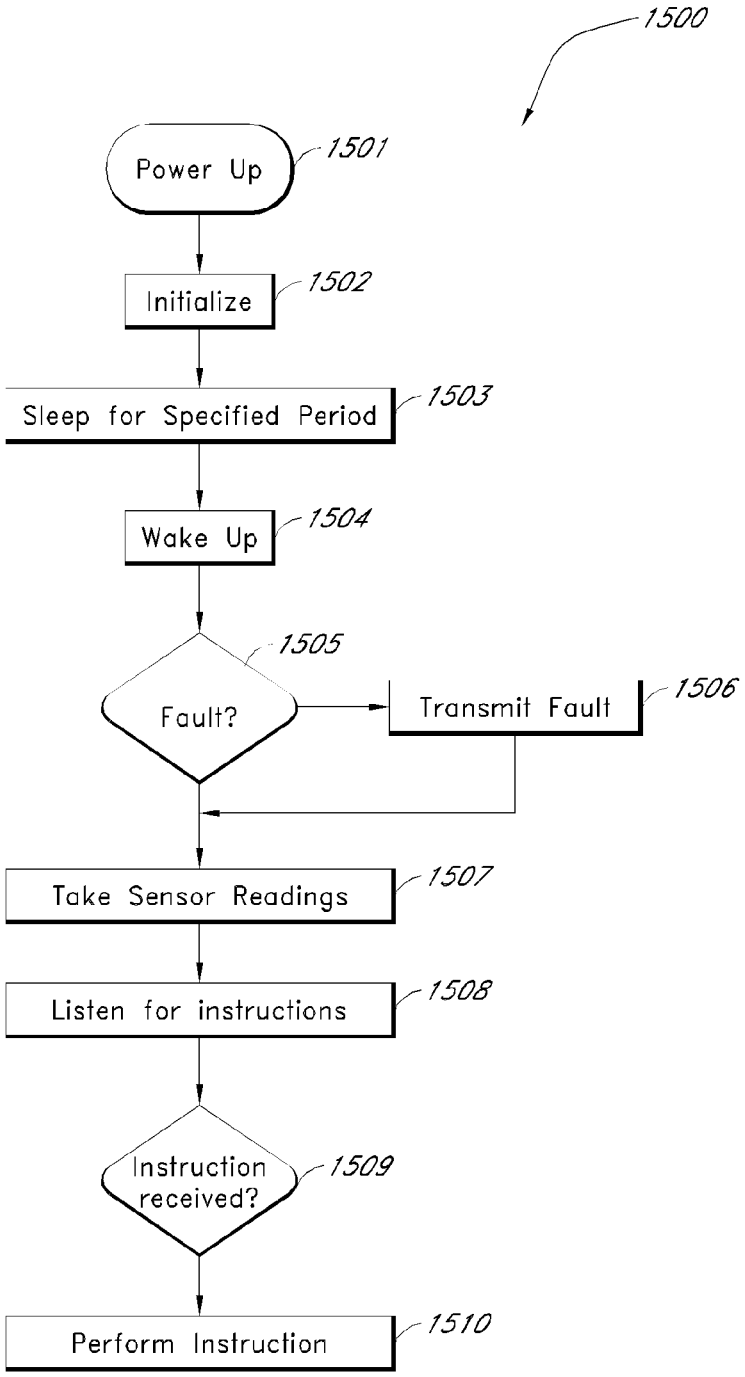
FIG. 15 is a flowchart showing one embodiment of an instruction and sensor data loop for a motorized shade or group controller.

Although the listen block 1403 can be implemented to use relatively little power, a sleep block can be implemented to use even less power. FIG. 15 is a flowchart showing one embodiment of an instruction and sensor data loop process 1500 for a motorized shade or group controller. The process 1500 begins at a power-up block 1501. After power up, the process proceeds to an initialization block 1502. After initialization, the process advances to a "sleep" block 1503 wherein the motorized shade or group controller sleeps for a specified period of time. When the sleep period expires, the process advances to a wakeup block 1504 and then to a decision 1505. In the decision block 1505, if a fault is detected, then a transmit fault block 1506 is executed. The process then advances to a sensor block 1507 where sensor readings are taken. After taking sensor readings, the process advances to a listen-for-instructions block 1508. If an instruction has been received, then the process advances to a "perform instruction" block 1510; otherwise, the process returns to the sleep block 1503.

Figure 16:
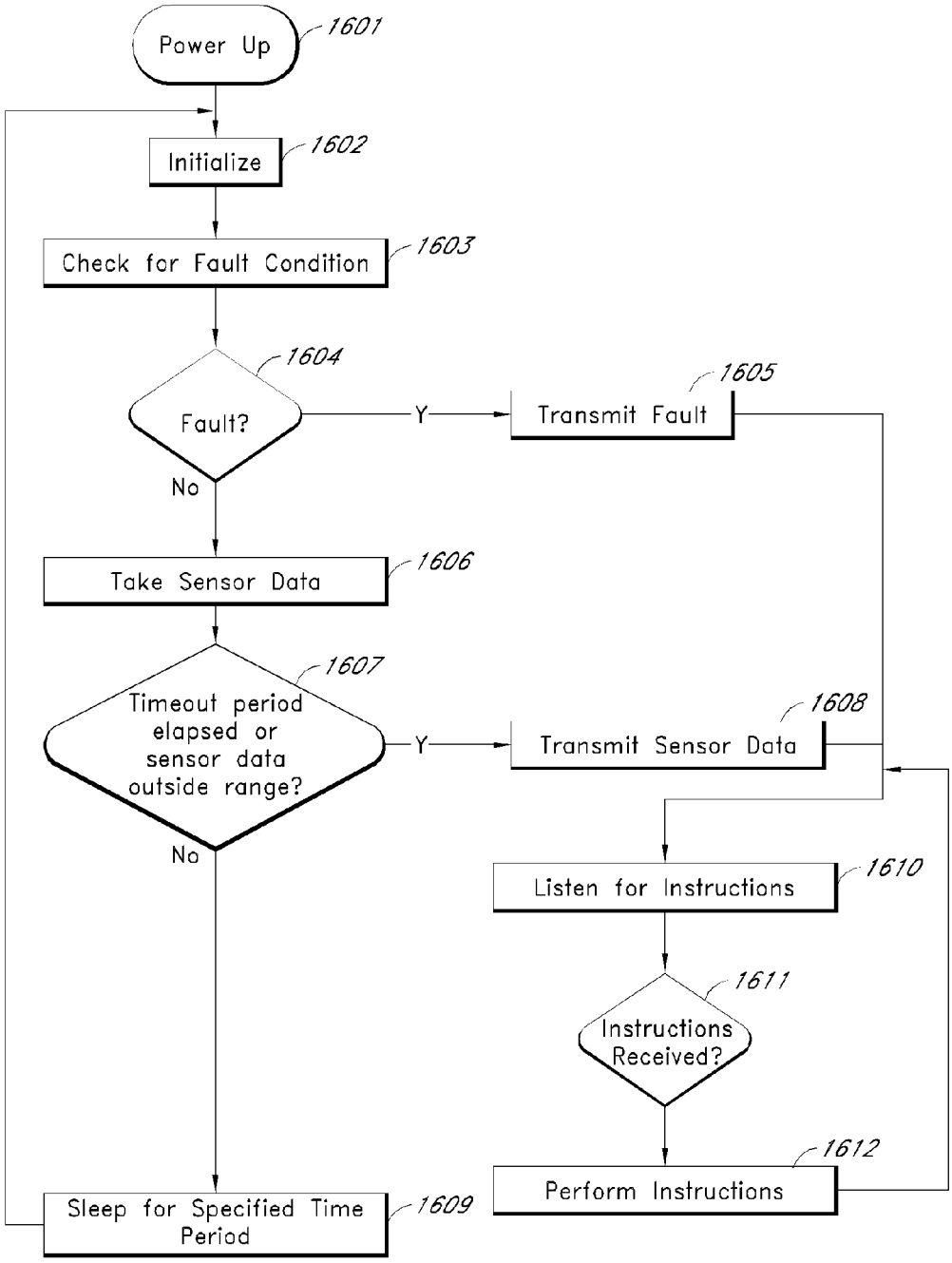
FIG. 16 is a flowchart showing one embodiment of an instruction and sensor data reporting loop for a motorized shade or group controller.

FIG. 16 is a flowchart showing one embodiment of an instruction and sensor data reporting loop process 1600 for a motorized shade or group controller. The process 1600 begins at a power-up block 1601. After power up, the process proceeds to an initialization block 1602. After initialization, the process advances to a check fault block 1603. If a fault is detected then a decision block 1604 advances the process to a transmit fault block 1605; otherwise, the process advances to a sensor block 1606 where sensor readings are taken. The data values from one or more sensors are evaluated, and if the sensor data is outside a specified range, or if a timeout period has occurred, then the process advances to a transmit data block 1608; otherwise, the process advances to a sleep block 1609. After transmitting in the transmit fault block 1605 or the transmit sensor data block 1608, the process advances to a listen block 1610 where the motorized shade or group controller listens for instructions. If an instruction is received, then a decision block advances the process to a perform instruction block 1612; otherwise, the process advances to the sleep block 1609. After executing the perform instruction block 1612, the process transmits an "instruction complete message" and returns to the listen block 1610.

The process flows shown in FIGS. 14-16 show different levels of interaction between devices and different levels of power conservation in the motorized shade and/or group controller. One of ordinary skill in the art will recognize that the motorized shade and group controller are configured to receive sensor data and user inputs, report the sensor data and user inputs to other devices in the zone control system, and respond to instructions from other devices in the zone control system. Thus, the process flows shown in FIGS. 14-16 are provided for illustrative purposes and not by way of limitation. Other data reporting and instruction processing loops will be apparent to those of ordinary skill in the art by using the disclosure herein.

In one embodiment, the motorized shade and/or group controller "sleep," between sensor readings. In one embodiment, the central system 601 sends out a "wake up" signal. When a motorized shade or group controller receives a wake up signal, it takes one or more sensor readings, encodes it into a digital signal, and transmits the sensor data along with an identification code.

In one embodiment, the motorized shade is bi-directional and configured to receive instructions from the central system. Thus, for example, the central system can instruct the motorized shade to: perform additional measurements; go to a standby mode; wake up; report battery status; change wake-up interval; run self-diagnostics and report results; etc.

In one embodiment, the motorized shade provides two wake-up modes, a first wake-up mode for taking measurements (and reporting such measurements if deemed necessary), and a second wake-up mode for listening for commands from the central system. The two wake-up modes, or combinations thereof, can occur at different intervals.

In one embodiment, the motorized shades use spread-spectrum techniques to communicate with the group controllers and/or the central system. In one embodiment, the motorized shades use frequency-hopping spread-spectrum. In one embodiment, each motorized shade has an Identification code (ID) and the motorized shades attaches its ID to outgoing communication packets. In one embodiment, when receiving wireless data, each motorized shade ignores data that is addressed to other motorized shades.

In one embodiment, the motorized shade provides bi-directional communication and is configured to receive data and/or instructions from the central system. Thus, for example, the central system can instruct the motorized shade to perform additional measurements, to go to a standby mode, to wake up, to report battery status, to change wake-up interval, to run self-diagnostics and report results, etc. In one embodiment, the motorized shade reports its general health and status on a regular basis (e.g., results of self-diagnostics, battery health, etc.)

In one embodiment, the motorized shade use spread-spectrum techniques to communicate with the central system. In one embodiment, the motorized shade uses frequency-hopping spread-spectrum. In one embodiment, the motorized shade has an address or identification (ID) code that distinguishes the motorized shade from the other motorized shades. The motorized shade attaches its ID to outgoing communication packets so that transmissions from the motorized shade can be identified by the central system. The central system attaches the ID of the motorized shade to data and/or instructions that are transmitted to the motorized shade. In one embodiment, the motorized shade ignores data and/or instructions that are addressed to other motorized shades.

In one embodiment, the motorized shades, group controllers, central system, etc., communicate on a 900 MHz frequency band. This band provides relatively good transmission through walls and other obstacles normally found in and around a building structure. In one embodiment, the motorized shades and group controllers communicate with the central system on bands above and/or below the 900 MHz band. In one embodiment, the motorized shades and group controllers listen to a radio frequency channel before transmitting on that channel or before beginning transmission. If the channel is in use, (e.g., by another device such as another central system, a cordless telephone, etc.) then the motorized shades and/or group controllers change to a different channel. In one embodiment, the sensor, central system coordinates frequency hopping by listening to radio frequency channels for interference and using an algorithm to select a next channel for transmission that avoids the interference. In one embodiment, the motorized shade and/or group controller transmits data until it receives an acknowledgement from the central system that the message has been received.

Frequency-hopping wireless systems offer the advantage of avoiding other interfering signals and collisions. Moreover, there are regulatory advantages given to systems that do not transmit continuously at one frequency. Channel-hopping transmitters change frequencies after a period of continuous transmission, or when interference is encountered. These systems may have higher transmit power and relaxed limitations on in-band spurs.

In one embodiment, the controller 301 reads the sensors at regular periodic intervals. In one embodiment, the controller 301 reads the sensors at random intervals. In one embodiment, the controller 301 reads the sensors in response to a wake-up signal from the central system. In one embodiment, the controller 301 sleeps between sensor readings.

In one embodiment, the motorized shade transmits sensor data until a handshaking-type acknowledgement is received. Thus, rather than sleep if no instructions or acknowledgements are received after transmission (e.g., after the instruction block 1510, 1405, 1612 and/or the transmit blocks 1605, 1608) the motorized shade retransmits its data and waits for an acknowledgement. The motorized shade continues to transmit data and wait for an acknowledgement until an acknowledgement is received. In one embodiment, the motorized shade accepts an acknowledgement from a zone thermometer and it then becomes the responsibility of the zone thermometer to make sure that the data is forwarded to the central system. The two-way communication ability of the motorized shade and zone thermometer provides the capability for the central system to control the operation of the motorized shade and/or zone thermometer and also provides the capability for robust handshaking-type communication between the motorized shade, the zone thermometer, and the central system.

In one embodiment of the system 600 shown in FIG. 6, the motorized shades 602, 603 send window temperature data to the group controller 601. The group controller 601 compares the window temperature to the room temperature and the setpoint temperature and makes a determination as to whether the motorized shades 602, 603 should be open or closed. The group controller 601 then sends commands to the motorized shades 602, 603 to open or close the windows. In one embodiment, the group controller 601 displays the window position on the visual display 1110.

In one embodiment of the system 600 shown in FIG. 6, the group controller 601 sends setpoint information and current room temperature information to the motorized shades 602, 603. The motorized shades 602, 603 compare the window temperature to the room temperature and the setpoint temperature and makes a determination as to whether to open or close the windows. In one embodiment, the motorized shades 602, 603 send information to the group controller 601 regarding the relative position of the windows (e.g., open, closed, partially open, etc.).

In the systems 700, 750, 800, 900 (the centralized systems) the group controllers 707, 708 send room temperature and setpoint temperature information to the central system. In one embodiment, the group controllers 707, 708 also send temperature slope (e.g., temperature rate of rise or fall) information to the central system. In the systems where the thermostat 720 is provided to the central system or where the central system controls the HVAC system, the central system knows whether the HVAC system is providing heating or cooling; otherwise, the central system uses window temperature information provide by the motorized shades 702-705 to determine whether the HVAC system is heating or cooling. In one embodiment, motorized shades send window temperature information to the central system. In one embodiment, the central system queries the motorized shades by sending instructions to one or more of the motorized shades 702-705 instructing the motorized shade to transmit its window temperature.

The central system determines how much to open or close motorized shades 702-705 according to the available heating and cooling capacity of the HVAC system and according to the priority of the zones and the difference between the desired temperature and actual temperature of each zone. In one embodiment, the occupants use the group controller 707 to set the setpoint and priority of the zone 711, the group controller 708 to set the setpoint and priority of the zone 712, etc. In one embodiment, the occupants use the central system console 1300 to set the setpoint and priority of each zone, and the group controllers to override (either on a permanent or temporary basis) the central settings. In one embodiment, the central console 1300 displays the current temperature, setpoint temperature, temperature slope, and priority of each zone.

In one embodiment, the central system allocates HVAC light to each zone according to the priority of the zone and the temperature of the zone relative to the setpoint temperature of the zone. Thus, for example, in one embodiment, the central system provides relatively more HVAC light to relatively higher priority zones that are not at their temperature setpoint than to lower priority zones or zones that are at or relatively near their setpoint temperature. In one embodiment, the central system avoids closing or partially closing too many windows in order to avoid reducing light in the window below a desired minimum value.

In one embodiment, the central system monitors a temperature rate of rise (or fall) in each zone and sends commands to adjust the amount each motorized shade 702-705 is open to bring higher priority zones to a desired temperature without allowing lower-priority zones to stray too far form their respective setpoint temperature.

In one embodiment, the central system uses predictive modeling to calculate an amount of window opening for each of the motorized shades 702-705 to reduce the number of times the windows are opened and closed and thereby reduce power usage by the motors 409. In one embodiment, the central system uses a neural network to calculate a desired window opening for each of the motorized shades 702-705. In one embodiment, various operating parameters such as the capacity of the central HVAC system, the volume of the house, etc., are programmed into the central system for use in calculating window openings and closings. In one embodiment, the central system is adaptive and is configured to learn operating characteristics of the HVAC system and the ability of the HVAC system to control the temperature of the various zones as the motorized shades 702-705 are opened and closed. In an adaptive learning system, as the central system controls the motorized shades to achieve the desired temperature over a period of time, the central system learns which motorized shades need to be opened, and by how much, to achieve a desired level of heating and cooling for each zone. The use of such an adaptive central system is convenient because the installer is not required to program HVAC operating parameters into the central system. In one embodiment, the central system provides warnings when the HVAC system appears to be operating abnormally, such as, for example, when the temperature of one or more zones does not change as expected (e.g., because the HVAC system is not operating properly, a window or door is open, etc.).

In one embodiment, the adaptation and learning capability of the central system uses different adaptation results (e.g., different coefficients) based on light levels, whether the HVAC system is heating or cooling, the outside temperature, a change in the setpoint temperature or priority of the zones, etc. Thus, in one embodiment, the central system uses a first set of adaptation coefficients when the HVAC system is cooling, and a second set of adaptation coefficients when the HVAC system is heating. In one embodiment, the adaptation is based on a predictive model. In one embodiment, the adaptation is based on a neural network.

Figure 17:
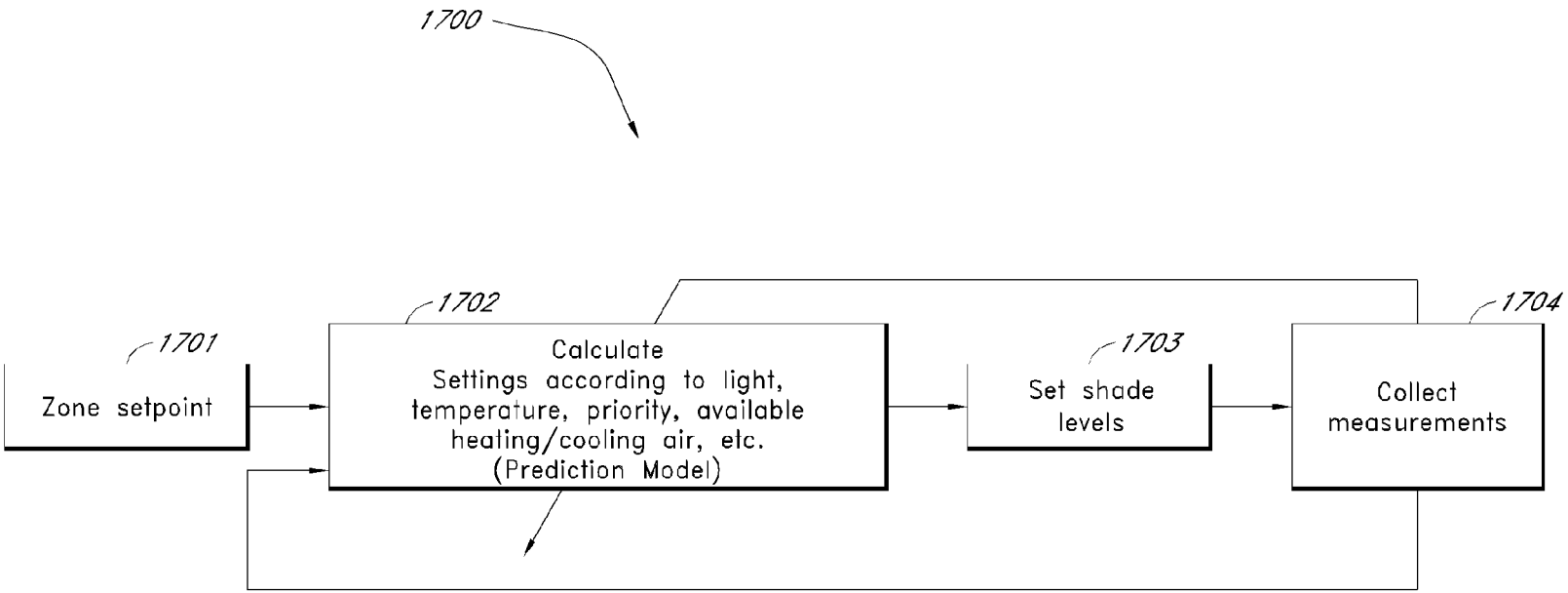
FIG. 17 is a block diagram of a control algorithm for controlling the motorized shades.

FIG. 17 is a block diagram of a control algorithm 1700 for controlling the motorized shades. For purposes of explanation, and not by way of limitation, the algorithm 1700 is described herein as running on the central system. However, one of ordinary skill in the art will recognize that the algorithm 1700 can be run by the central system, by the group controller, by the motorized shade, or the algorithm 1700 can be distributed among the central system, the group controller, and the motorized shade. In the algorithm 1700, in a block 1701 of the algorithm 1700, the setpoint light levels from one or more group controllers are provided to a calculation block 1702. The calculation block 1702 calculates the motorized shade settings (e.g., how much to open or close each motorized shade) according to the desired light level, privacy level, etc. In one embodiment, the block 1702 uses a predictive model as described above. In one embodiment, the block 1702 calculates the motorized shade settings for each group independently (e.g., without regard to interactions between group). In one embodiment, the block 1702 calculates the motorized shade settings for each zone in a coupled-zone manner that includes interactions between groups. In one embodiment, the calculation block 1702 calculates new window openings by taking into account the current window openings and in a manner configured to minimize the power consumed by opening and closing the motorized shades.

Window shade settings from the block 1702 are provided to each of the motorized shade motors in a block 1703, wherein the motorized shades are moved to new opening positions as desired (and, optionally, one or more of the fans 402 are turned on to pull additional light from desired windows). After setting the new window openings in the block 1703, the process advances to a block 1704 where new measurement values (e.g., temperature, light, privacy, etc.) are obtained from the group controllers (the new zone temperatures and light levels being responsive to the new motorized shade settings made in block 1703). The new zone temperatures are provided to an adaptation input of the block 1702 to be used in adapting a predictive model used by the block 1702. The new zone temperatures also provided to a temperature input of the block 1702 to be used in calculating new motorized shade settings.

As described above, in one embodiment, the algorithm used in the calculation block 1702 is configured to predict the motorized shade opening needed to bring each group to the desired setting based on the current temperature, the available heating and cooling, the amount of light available through each motorized shade, etc. The calculating block uses the prediction model to attempt to calculate the motorized shade openings needed for relatively long periods of time in order to reduce the power consumed in unnecessarily by opening and closing the motorized shades. In one embodiment, the motorized shades are battery powered, and thus reducing the movement of the motorized shades extends the life of the batteries. In one embodiment, the block 1702 uses a predictive model that learns the characteristics of the system and the various zones and thus, the model prediction tends to improve over time.

In one embodiment, the group controllers report zone temperatures and/or light levels to the central system and/or the motorized shades at regular intervals. In one embodiment, the group controllers report zone temperatures to the central system and/or the motorized shades after the zone temperature has changed by a specified amount specified by a threshold value. In one embodiment, the group controllers report zone temperatures to the central system and/or the motorized shades in response to a request instruction from the central system or motorized shade.

In one embodiment, the group controllers report setpoint temperatures and/or light levels, zone priority values, etc. to the central system or motorized shades whenever the occupants change the setpoint temperatures or zone priority values using the user controls 1102. In one embodiment, the group controllers report setpoint temperatures and zone priority values to the central system or motorized shades in response to a request instruction from the central system or motorized shades.

In one embodiment, the occupants can choose the thermostat deadband value (e.g., the hysteresis value) used by the calculation block 1702. A relatively larger deadband value reduces the movement of the motorized shade at the expense of larger temperature variations in the zone.

In one embodiment, the occupant sensor 1201 is used to change the privacy priority from relatively lower to relatively higher priority. Thus, for example, the system can be configured to provide relatively more privacy when a room or area is occupied than when the area is unoccupied. In one embodiment, a hysteresis-like value is used in connection with the occupancy sensor such that the privacy setting of an area changes relatively slowly so that the motorized shades do not run up and down repeatedly if a person walks in and out the area detected by the occupant sensor 1201. In one embodiment, the system 601 uses the data from the occupant sensor 1201 to learn when an area is likely to be occupied or unoccupied for a period of time and vary the privacy setting accordingly.

In one embodiment, the motorized shades report sensor data (e.g., window temperature, light, power status, position, etc.) to the central system and/or the group controllers at regular intervals. In one embodiment, the motorized shades report sensor data to the central system and/or the group controllers whenever the sensor data fails a threshold test (e.g., exceeds a threshold value, falls below a threshold value, falls inside a threshold range, or falls outside a threshold range, etc.). In one embodiment, the motorized shades report sensor data to the central system and/or the group controllers in response to a request instruction from the central system or group controller.

In one embodiment, the central system is shown in FIGS. 7-9 is implemented in a distributed fashion in the group controllers 1100 and/or in the motorized shades. In the distributed system, the central system does not necessarily exists as a distinct device, rather, the functions of the central system can be are distributed in the group controllers 1100 and/or the motorized shades. Thus, in a distributed system, FIGS. 7-9 represent a conceptual/computational model of the system. For example, in a distributed system, each group controller 100 knows its zone priority, and the group controllers 1100 in the distributed system negotiate to allocate the available light, privacy, heating/cooling, etc. among the zones. In one embodiment of a distributed system, one of the group controller assumes the role of a master thermostat that collects data from the other group controllers and implements the calculation block 1902. In one embodiment of a distributed system, the group controllers operate in a peer-to-peer fashion, and the calculation block 1902 is implemented in a distributed manner across a plurality of group controllers and/or motorized shades.

In one embodiment, the motorized shade reports its power status to the central system or group controller. In one embodiment the central system or group controller takes such power status into account when determining new motorized shade openings. Thus, for example, if there are first and second motorized shades serving one zone and the central system knows that the first motorized shade is low on power, the central system will use the second motorized shade to modulate the light into the zone. If the first motorized shade is able to use the fan 402 or other light-based generator to generate electrical power, the central system will instruct the second motorized shade to a relatively closed position in and direct relatively more light through the first motorized shade when directing light into the zone.

In one embodiment, the central system or group controller instructs the shades to open in response to a fire or smoke alarm signal. In one embodiment, the central system or group controller instructs the shades to open or close in response to a signal from a burglar alarm system. In one embodiment, the central system or group controller instructs the shades to open or close in response to a window open, window close, door open, and/or door close signal from a burglar alarm-type system. In one embodiment, the group controller is provided to a network connection (e.g., an Internet connection, cellular telephone connection, telephone connection etc.) to allow the homeowner to remotely open or close the blinds or to remotely change priority parameters in the control system (e.g., desired relative priority of privacy, temperature, and light, desired temperature, desired privacy level, desired light level, etc.). In one embodiment, the user can remotely control the network-connected group controller via telephone or cellular telephone.

Figure 18:
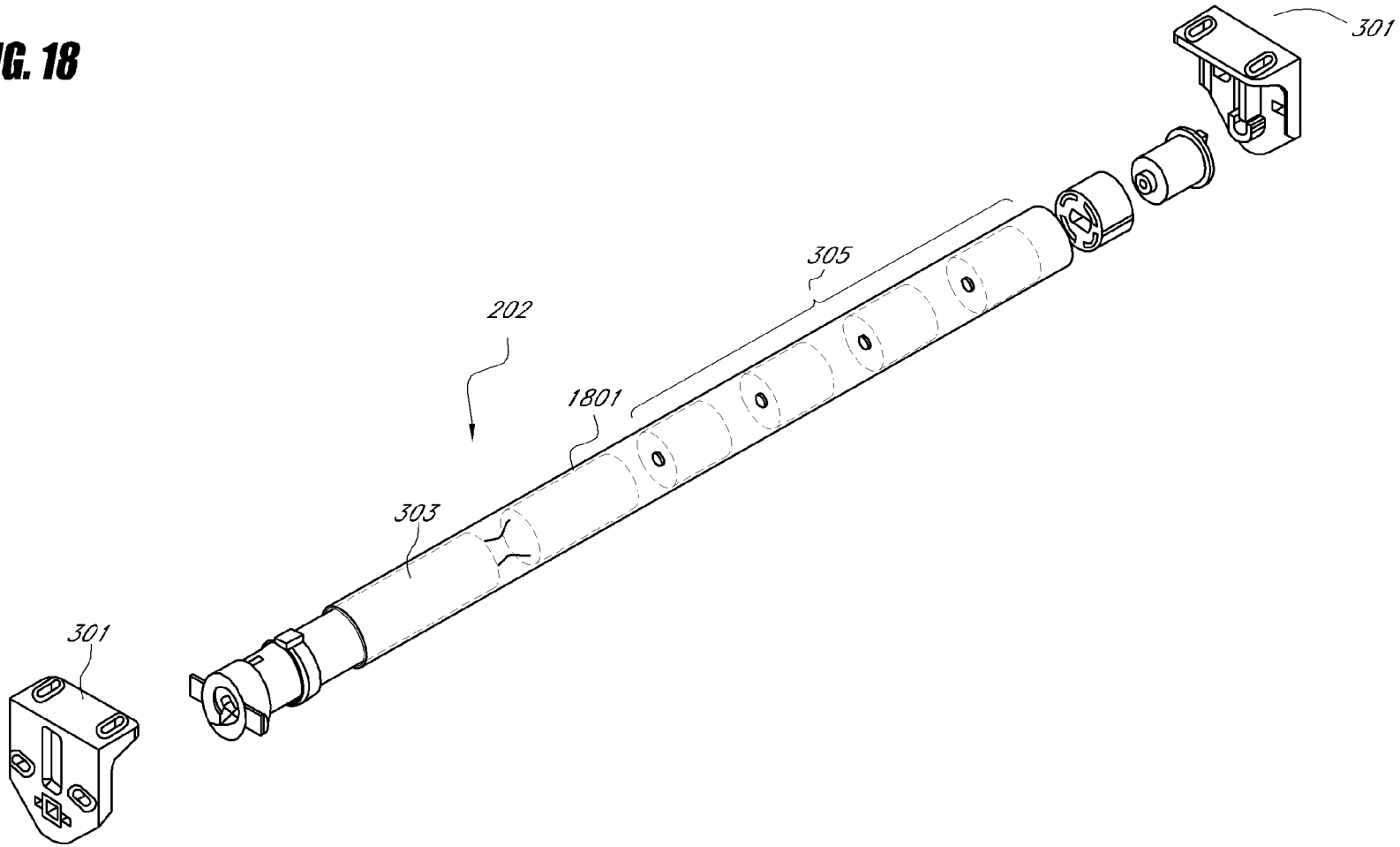
FIG. 18 shows one embodiment of a motorized shade with internal batteries

FIG. 18 shows one embodiment of a motorized shade, with a tubular motor 303, internal batteries as the power source 350, and an electronics module 1801. The electronics module includes for example, the controller 301, the optional capacitor 306, the RF transceiver 302, and the optional RFID tag 309.

Figure 19:
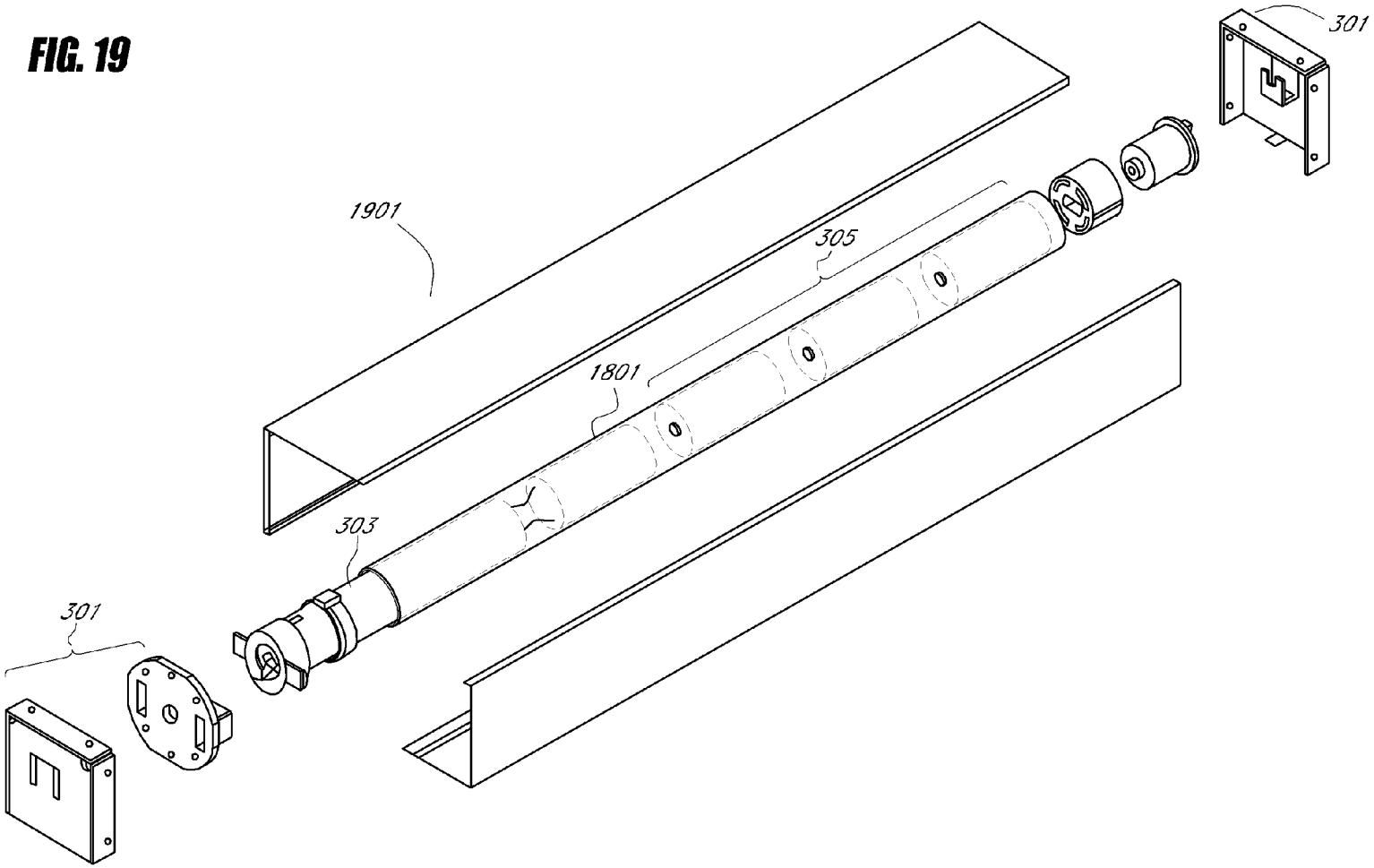
FIG. 19 shows one embodiment of a motorized shade with internal batteries and a fascia.

FIG. 19 shows one embodiment of a motorized shade with a tubular motor 303, internal batteries as the power source 350, the electronics module 1801, and a fascia 1901.

It will be evident to those skilled in the art that the motorized shade is not limited to the details of the foregoing illustrated embodiments and that the present motorized shade may be embodied in other specific forms without departing from the spirit or essential attributed thereof; furthermore, various omissions, substitutions and changes may be made without departing from the spirit of the invention. For example, although specific embodiments are described in terms of the 900 MHz frequency band, one of ordinary skill in the art will recognize that frequency bands above and below 900 MHz can be used as well. The wireless system can be configured to operate on one or more frequency bands, such as, for example, the HF band, the VHF band, the UHF band, the Microwave band, the Millimeter wave band, etc. One of ordinary skill in the art will further recognize that techniques other than spread spectrum can also be used and/or can be used instead spread spectrum. The modulation used is not limited to any particular modulation method, such that modulation scheme used can be, for example, frequency modulation, phase modulation, amplitude modulation, combinations thereof, etc. The one or more of the wireless communication systems described above can be replaced by wired communication. The one or more of the wireless communication systems described above can be replaced by powerline networking communication. The foregoing description of the embodiments is, therefore, to be considered in all respects as illustrative and not restrictive, with the scope of the invention being delineated by the appended claims and their equivalents.

What is claimed is:

1. An electronically-controlled motorized roll-up window shade, comprising:

a controller;

a tubular motor provided to said controller, said tubular motor configured to raise and lower a shade material, said tubular motor disposed in a tube member wherein said shade material rolls onto said tube member when said shade material is raised;

a first power source provided to said controller, said first power source disposed in said tube member; and a two-way wireless communication system provided to said controller, said controller configured to control said motor in response to a wireless communication received from a group controller, said group controller configured to open and close said motorized shade to produce a desired room temperature during the day and to provide privacy at night, wherein said group controller is provided to an HVAC system to provide coordinated temperature control using said motorized shade and said HVAC system.

2. An electronically-controlled motorized roll-up window shade, comprising:

a controller;

a tubular motor provided to said controller, said tubular motor configured to raise and lower a shade material, said tubular motor disposed in a tube member wherein said shade material rolls onto said tube member when said shade material is raised;

a first power source provided to said controller, said first power source disposed in said tube member; and a two-way wireless communication system provided to said controller, said controller configured to control said motor in response to a wireless communication received from a group controller, said group controller configured to open and close said motorized shade to produce a desired room temperature during the day and to provide privacy at night, wherein said group controller is provided to a central controller to provide coordinated temperature control using said motorized shade and said HVAC system.

3. The electronically-controlled motorized shade of claim 2, wherein said central controller is provided to a home computer to provide coordinated temperature control using said motorized shade and said HVAC system.

4. The electronically-controlled motorized shade of claim 2, wherein said central controller is provided to an HVAC system to provide coordinated temperature control using said motorized shade and said HVAC system.

5. The electronically-controlled motorized shade of claim 2, wherein said central controller is provided to a zoned HVAC system to provide coordinated temperature control using said motorized shade and said HVAC system.

6. The electronically-controlled motorized shade of claim 5, wherein said central controller cooperates with said zoned HVAC system to use said motorized shade to partially control a temperature of a desired zone.

7. An electronically-controlled motorized roll-up window shade, comprising:

a controller;

a tubular motor provided to said controller, said tubular motor configured to raise and lower a shade material, said tubular motor disposed in a tube member wherein said shade material rolls onto said tube member when said shade material is raised;

a first power source provided to said controller, said first power source disposed in said tube member; and a two-way wireless communication system provided to said controller, said controller configured to control said motor in response to a wireless communication received from a group controller, said group controller configured to open and close said motorized shade to produce a desired room temperature during the day and to provide privacy at night, said controller configured to use a predictive model to compute a control program.

8. The electronically-controlled motorized shade of claim 7, said control program configured to reduce power consumption by said tubular motor.

9. The electronically-controlled motorized shade of claim 7, said control program configured to reduce movement of said tubular motor.

10. An electronically-controlled motorized roll-up window shade, comprising:

a controller;

a tubular motor provided to said controller, said tubular motor configured to raise and lower a shade material, said tubular motor disposed in a tube member wherein said shade material rolls onto said tube member when said shade material is raised;

a first power source provided to said controller, said first power source disposed in said tube member; and a two-way wireless communication system provided to said controller, said controller configured to control said motor in response to a wireless communication received from a group controller, said group controller configured to open and close said motorized shade to produce a desired room temperature during the day and to provide privacy at night, comprising a group controller configured to use a predictive model to compute a control program for said motorized shade.

* * * * *